US006763634B1

(12) United States Patent
Thompson

(10) Patent No.: US 6,763,634 B1
(45) Date of Patent: Jul. 20, 2004

(54) RETROFIT HURRICANE-EARTHQUAKE CLIP

(76) Inventor: Thomas C. Thompson, 92-543 Kokole Pl., Makakilo, HI (US) 96707

( * ) Notice: Subject to any disclaimer, the term of this patent is extended or adjusted under 35 U.S.C. 154(b) by 0 days.

(21) Appl. No.: 09/810,751

(22) Filed: Dec. 15, 1998

Related U.S. Application Data

(63) Continuation-in-part of application No. 09/001,744, filed on Dec. 31, 1997, now abandoned.

(51) Int. Cl.[7] ..... E04B 1/38

(52) U.S. Cl. ..... 52/92.2; 52/93.2; 52/167.1; 52/713

(58) Field of Search ..... 52/93.2, 93.1, 52/92.1, 92.3, 167.1, 713, 92.2; 403/235

(56) References Cited

U.S. PATENT DOCUMENTS

| | | | | | |
|---|---|---|---|---|---|
| 1,353,538 | A | * | 9/1920 | Mitchell | |
| 1,599,335 | A | * | 9/1926 | Levens | |
| 2,413,362 | A | | 12/1946 | Maxwell et al. | |
| 3,091,822 | A | | 6/1963 | Fiekers et al. | |
| 3,256,030 | A | | 6/1966 | Banse | |
| 4,410,294 | A | | 10/1983 | Gilb et al. | |
| 4,592,186 | A | * | 6/1986 | Braginetz | 52/699 |
| 4,896,985 | A | | 1/1990 | Commins | |
| 5,092,097 | A | * | 3/1992 | Young | 52/702 |
| 5,109,646 | A | | 5/1992 | Colonias et al. | |
| 5,257,483 | A | | 11/1993 | Netek | |
| 5,303,520 | A | | 4/1994 | Gozdziak | |
| 5,311,708 | A | | 5/1994 | Frye | |
| 5,357,721 | A | * | 10/1994 | Alvarez | 52/92.2 |
| 5,384,993 | A | * | 1/1995 | Phillips | 52/92.2 |
| 5,423,156 | A | * | 6/1995 | Nellessen | 52/715 |
| 5,560,156 | A | | 10/1996 | McDonald | |
| 5,561,949 | A | | 10/1996 | Knoth | |
| 5,687,938 | A | * | 11/1997 | Bailey | 248/74.1 |
| 5,762,436 | A | * | 6/1998 | Mosdal | 403/235 X |
| 6,094,880 | A | * | 8/2000 | Thompson | 52/712 |

* cited by examiner

*Primary Examiner*—Robert Canfield

(57) ABSTRACT

A true retrofit hurricane and earthquake clip for connecting the roof rafter, to the outside sheathing and underlying top plate. The connector is composed of sheet metal including a base web and top web, connected by an arched saddle. The wide base web has a left and right side with nail holes for fastening to the outside sheathing. The base web holds the sheathing securely to the wall and prevents bowing out and lateral movement. The top web has left and right sides with nail holes for fastening to the widest edges of a rafter preventing uplift, outward thrusting, and twisting. The saddle connects the top web and base web, and forms a cradle for the bottom of the rafter. The angled saddle avoids any demolition of frieze boards or trim on the house, making for effortless installation. The connector is easily installed by a homeowner on existing houses with the saddle clasping the rafter and outside sheathing. The saddle adds stability, limits twisting, prevents the wall from bowing out, and makes the connector practically invisible from the side of the house.

19 Claims, 19 Drawing Sheets

RETROFIT HURRICANE-EARTHQUAKE CLIP

This is a continuation-in-part of application Ser. No. 09/001,744, filed Dec. 31, 1997 now abandoned.

BACKGROUND

1. Field of Invention

This invention relates to an innovative retrofit connector that permanently connects the roof to the outside wall to create buildings that are stronger and more resistant to hurricanes and earthquakes.

2. Description of Prior Art

Recent studies of hurricane damage on wood-frame buildings indicate that extensive damage was generated to a house by strong winds, when the roof rafters, roof trusses, and roof purlins twisted or were torn from the outside wall.

Roof sheathing ties all the rafters or purlins together on a wood frame house, and the roof sheathing ties all the roof trusses together when a masonry or wood-frame house is constructed with trusses. If the rafters or trusses rack or twist from the wind forces, the roof sheathing can detach from the roof allowing rain to enter the house.

Sheathing that is tightly secured to the rafters or trusses and subsequently fastened to the walls, helps transfer uplifting forces to the walls and henceforth to the foundation. If the roof sheathing fails, the trusses collapse, and the walls usually fall down as they can not stand by themselves against strong winds.

Failure of the outside wall sheathing is common during hurricanes, because of inadequate fastening of the sheathing to the underlying structural members. This invention helps prevent the wall sheathing from splitting, racking, and detaching from the wall. The extreme negative pressure of a hurricane blows out the sheathing from walls, but this invention holds the sheathing tight to the walls, as sheet metal joints perform better than nailed joints in high winds and during seismic activity.

Hurricanes

Studies of damage after Hurricane Andrew show several problems with the attachment of roof rafters and roof trusses that this invention solves.

Roof overhangs act like wings, creating huge uplifting forces during strong winds. This uplift tears apart the rafters that are toe-nailed to the header or top plate. The uplift can also twist rafters and roof trusses weakening the toenailed connections and causing detachment.

The one thing that ties together the top plate, studs, and sill plate is the outside sheathing. This invention effectively ties together the rafter, top plate, and outside sheathing to form a continuous load-path to the sill plate. Attaching my invention to the rafter and top plate junction puts the nails perpendicular to the uplifting force and would require shearing the nails in order to lift the rafter or truss.

One significant factor in building construction is precision framing, where the rafter is installed directly above the stud. Unfortunately, in existing houses this is rarely the case.

Post-and-beam construction is very common in older homes in mild-weather areas, and we have found that the wall studs, or in this case, posts, are only under every fourth rafter, and the rafters can be 4-feet on center. Usually, the posts are directly under where the top plate butts up against the top plate in the run. The rafter is to one side of this butt joint, so the rafter does not line up directly over the post.

On newer stud-wall construction, we have seen that studs rarely line up directly under the rafters. We saw a house where the walls have studs 16-inches on center, constructed with a roof that had rafters 24-inches on center. This means the only rafter and stud that will line up to form a continuous load-path is every fourth stud or every other rafter. What are the odds that they will exactly line up?

Another problem with home construction is on misinstallation of prior art hurricane clips that are made for new construction and covered by wall sheathing. After Hurricane Andrew, there were many examples of careless and inferior attachment of hurricane clips or they were entirely missing. One company has visited new construction sites and documented many examples of shoddy and incorrect application of their products.

To achieve a continuous load-path on existing houses the outside sheathing must be taken into account. The most important tie in an existing house is between the rafter and top plate or roof truss and top plate. Any uplifting wind force on the roof must be transferred to the walls. In tropical climates, the roof purlin, an intermediate structural member, may separate from the rafter with the roof sheathing.

My invention effectively ties together the rafter or roof truss, top plate, and outside sheathing (and indirectly, the wall studs) to form the most practical and economical continuous load path from the roof to the foundation.

Earthquakes

During an earthquake, the floor, wall, and roof diaphragms undergo shearing and bending. The shear forces from the roof boundary members are transferred to the top of the shear wall by way of toenails to the top plate. To withstand and transfer the shear loads, the connection between the roof and wall must be strong.

The outside sheathing provides lateral stability to the walls, preventing racking. The sheathing also absorbs and transfers earthquake forces by becoming a shear wall.

An earthquake can send motion into a house and separate the sheathing from the walls. The sheathing can come loose from the walls by the nails popping out or the plywood splitting away from the nails driven on it's edge. Some codes allow sheathing to be stapled to the wall studs, which is a weak connection. This invention helps prevent the sheathing from pulling away from the wall during earth movements.

Steel connectors, between different components of a wood-frame buildings superstructure, provide continuity so that the building will move as a unit in response to seismic activity (Yanev, 1974).

Prior Art

A number of connectors have been developed to tie together the structural members of a house under construction. Up until this invention, nobody had seen how to make a connector that could tie sheathing to the underlying structural members and connect to the side or "meat" of a rafter or roof truss without having material hanging down.

My co-pending application, Ser. No. 08/191,852, is a retrofit hurricane clip. Although it can be mounted on 2× rafters, it was designed for large timber rafters such as 4× stock, and has a web member that can be seen from the side. This invention uses a saddle and side webs for lateral support, and can not be seen from the side, hence it is stealth-like.

The leading manufacturer of wood construction connectors, the Simpson Strong-tie Company, shows no retrofit hurricane connectors in their catalog.

There are a number of ties that fasten the rafter to the top plate while a house is being constructed including: Knoth U.S. Pat. No. 5,561,949, McDonald U.S. Pat. No. 5,560,156, Colonias U.S. Pat. No. 5,380,115, Stuart U.S. Pat. No. 5,335,469, Colonias et al U.S. Pat. No. 5,109,646, Commins U.S. Pat. No. 4,714,372, Gilb U.S. Pat. No. 4,572,695, and Gilb et al U.S. Pat. No. 4,410,294.

These are good inventions, but they are difficult to retrofit onto existing houses without demolition of existing parts on a house. None were designed or patented to be retrofit on to an existing house.

The prior art hurricane clips provide little lateral strength, even when using a left and right. The prior art cannot tie the outside sheathing to the underlying top plate and roof rafter. They cannot clear frieze boards and prevent the outside sheathing from being sucked off during the extreme negative pressure of a hurricane.

The prior art inventions do not prevent the outside sheathing from splintering and disconnecting during earth tremors. They do not have multiple uses such as tieing the floor joists to the wall studs, the weakest parts of a wood-frame house in an earthquake.

Frye's anchor system, U.S. Pat. No. 5,311,708, is patented as a retrofit, but it does not tie the rafter to the top plate, cannot clear frieze boards, and ties into the weakest thin edge of the rafter while splitting it with bolts. Frye's 708 also provides no lateral support against side movements.

Netek's reinforcing tie, U.S. Pat. No. 5,257,483, is patented as a retrofit and may clear frieze boards, but it is temporary, and like Frye, ties into an even weaker thin edge of the end of the rafter. Netek's 483 also provides no lateral support against side movements.

There are several retrofit apparatus for securing roofs using cables. Adams U.S. Pat. No. 5,570,545 and Winger U.S. Pat. No. 5,319,896 are both temporary, meaning a homeowner must be home to deploy and anchor the ephemeral cables. The anchors can only be as secure as the nearby soil and the cables do not prevent the walls from bowing or blowing out.

There are a number of joist hangers that fasten to a joist and vertical member while a house is being constructed including: Colonias et al U.S. Pat. No. 5,104,252 and Gilb U.S. Pat. No. 4,480,941. These are good inventions, but they provide little lateral strength, and they are difficult to retrofit onto existing houses.

Joist hangers have a small ledge that supports all the weight from the joist beam. They hang the weight from the edge, rather than supporting the weight on top of the edge. They are also thin and parallel to the long dimension of the joist beam, concentrating all that carrying weight onto a vertical thin-section of the vertical member.

Gilb's complicated hanger, U.S. Pat. No. 4,261,155, is strong, but cannot be retrofit on to a house.

Prior art connectors relied on angled nailing, to provide lateral support, which is complex to, manufacture, and very difficult to install on a completed house.

Objects and Advantages

Accordingly, several objects and advantages of my invention are that it helps secure the roof and wall of a building to make the building a solid unit and preventing it from being destroyed by hurricanes and earthquakes.

This invention helps prevent the roof from being blown off the walls of an existing building. It keeps the roof rafters and roof trusses tightly secured to the outside sheathing and underlying top plate of the wall.

This invention helps prevent the roof rafters and roof trusses from twisting during strong winds, thereby preventing detaching of the roof material and underlying roof sheathing. It stiffens the edge of the roof and the top of the wall, helping to transfer lateral loads to the whole roof and walls.

This invention helps prevent the wall sheathing of a building from detaching from the wall studs during an earthquake. It helps make the outside wall into a stable shearwall, transferring shear forces into the foundation and ground.

One object of this invention is to make each outside wall on a house into a shearwall, that is, able to transfer forces without breaking or disconnecting. By tying the outside sheathing securely to the top plate and rafter or roof truss, the plywood can reliably transfer and dissipate shear, lateral, and uplift forces to the ground.

During an earthquake or a hurricane, a building with my invention will be a sturdy unit, resisting and transferring destructive forces to the ground.

Many older homes were constructed with the best materials and competent carpenters, but used the time-honored method of connecting the rafter to the top plate with nails driven into the edge of the rafter. This weak connection, called toe-nailing, is still in use today. Even if prior art hurricane clips were used in construction, the homeowner can't tell and those clips don't hold the outside wall sheathing to the wall.

Outside sheathing is usually secured to a wall stud under a rafter. Builders line up each plywood sheet on a wall stud for nailing. This invention has a large base member that keeps the plywood from separating from the wall during a hurricane. It also prevents the plywood sheets from sliding past each other during an earthquake.

Mounted on the roof rafter or roof truss, my invention resists uplift, the most destructive force during a hurricane. Mounted on the top plate and wall sheathing, my invention prevents the wall sheathing from being blown off or sucked out by the extreme negative pressure of a hurricane.

During an earthquake, when my clips are mounted on the roof and walls, they will make each member into a shear wall. The secured plywood will absorb and dissipate earth movements, without becoming detached from the underlying structural members. It will also prevent the sheathing from sliding past each other.

This would improve the house beyond existing building codes, as sheet metal joints have been proven to perform better than nailed joints during hurricanes and earthquakes.

Another object of this invention is the large surface area. This area prevents the plywood sheathing from splitting during hurricanes or earthquakes. The large surface area provides more strength in the connecting or hold-down process.

Yet another advantage of this invention is during earthquakes, nails can sometimes bend with the movements of the house, but screws often break. Even though screws hold tighter than nails and provide a tight connection against uplifting forces from hurricanes, they are less resistant against earth movements. This invention absorbs and transmits most of the forces during an earthquake and hurricane so nails and/or screws can be used as fasteners.

Another advantage is that since the invention absorbs and transfers earthquake and hurricane forces, less nails and nailing could be used. Also, screws could be used in the invention in earthquake areas with less fear that the heads will shear off Still another advantage of the invention is in the ability to prevent plywood sheets from sliding past or over each other during an earthquake. Previously, only nails had to shear, but this entire connector must be sheared for the invention to fail.

Still another advantage is that with the roof rafters and roof trusses better able to resist twisting, roof sheathing will stay firmly attached and roofing material will now have a better chance of staying on during strong winds and earth movements. In addition, with the sheathing now firmly connected, new materials may be attached to the roof, such as solar electric panels, without fear of them being blown off.

In areas with brush or forest fire danger, fire-proof material or heavy material, such as tile, stone or metal, can now be applied to the roof with less danger of being blown or shaken off during earth tremors or high winds. Fire-proof materials such as stucco or brick veneer can be applied to the wall sheathing with less chance of being shaken off during earth movements.

Earth tremors and hurricanes always destroy the weakest parts of a house. By making each envelope of a house, the vertical walls and roof envelope into a strong unit, there will be less damage.

It is a further object of this invention that it easily, quickly, and economically protects houses from the destructive forces of earthquakes and hurricanes. It is a still further object that the connectors and fasteners are strong, attractive, permanent, functional, uncomplicated, simple to manufacture, easy to install, and economical. All of the embodiments can be made from a single sheet metal blank, without any welding.

A further object is that this invention can be used on various size sheathing, rafters, roof trusses, studs, wood or metal I-beams, TJI, and glue-lams, all made from wood or metal. There may be insurance discounts for homeowners who have this invention installed on their houses.

As a retrofit, a handy homeowner can install this invention, or have it installed. The homeowner can easily see that the home is protected instead of wondering if hurricane clips were installed correctly during construction, or installed at all.

Traditional toe-nailing of the rafter is at the bird's-mouth, a notch cut into the rafter where it rests on the top plate. By cutting out material from the rafter, a bird's-mouth weakens the rafter. Toe-nailing only two nails from either side grasps only a small edge of the rafter, and the nail only extends into the top 2× of the top plate.

Tests were done by the Colorado School of Mines on my co-pending retrofit hurricane clip, application Ser. No. 08/191,852. The tests showed that the rafter split lengthwise, due to uplifting force, before my 852' clip failed.

This new retrofit invention strengthens the rafter to top plate connection by vastly increasing the spacing and amount of nails in the thickest part or "meat" of the rafter. This clip also strengthens the bird's mouth by wrapping on either side of the rafter and keeping it from splitting along the long measure.

As a retrofit, an insurance agent can observe that the home is protected and give appropriate discounts. Perspective home buyers can perceive that the building is protected, so the seller has a good selling point and can ask for a better price.

Since the stealth clip is a retrofit, and is not covered by sheathing or gypsum board, the invention is much thicker than prior hurricane clips and tensile values are dramatically increased.

Another advantage is with the top webs angled away from vertical, they form an upside-down flying buttress. This tremendously increases resistance to outward thrusts. This makes the roof much stronger and able to resist more weight such as thick snow, ice, or volcanic ash, and heavy roofing material such as tile, insulated roofing, solar collectors, and satellite dishes.

This invention takes the place of a left and right prior art hurricane clip, thus cost and installation time is substantially reduced. Installation can be accomplished with a power nailer or powered screw gun.

The left and right tabs, and the saddle combine to cradle the rafter, significantly increasing lateral strength over prior hurricane clips. The saddle carries no weight of the rafter, the bird's mouth cut of the rafter distributing the weight onto the top plate. Hence the saddle can have a curved shape, angled shape, compound angles, flat seat, or rounded seat.

Since this invention cradles the rafter or roof truss on the bottom, and left and right side, and has wide tabs anchored to the outside wall, torsional twisting is significantly reduced over prior art hurricane clips, as is cross-grain splitting.

Since the left and right tabs, and the saddle combine to significantly increase lateral stiffness, no part of the invention hangs below the rafter, hence it is invisible from the side. Architects and homeowners approve that this hurricane clip is concealed.

The left and right tabs, that are installed on opposite sides of the rafter have offset nail holes. Nails driven into the rafter will be offset from each other lessening wood splitting and vastly increasing holding power.

This invention does not require any removal of frieze boards or wood trim from the house. On houses where a frieze board is installed between rafters or roof trusses, this invention has an offset between the top and base webs that allows the invention to be installed as a retrofit. The offset clears any frieze board, wires, or trim that sticks out from the wall.

If the frieze board is warped or is slanted away from the house, the angled top web's position will clear it. If the frieze board is angled on one side of the rafter and straight on the other side of the rafter, this invention will still not be hindered in being retrofit on to a house.

By adding a simple embodiment, the roofing material and roof sheathing can be held down to the roof rafter. This invention can hold down roof sheathing to the rafter or roof truss, providing great rigidity to the entire house. This makes the house, significantly more resistant to strong winds and earth tremors.

In tropical climates, where hurricanes are common, roof purlins are used to support the roof sheathing, usually corrugated metal roofing, which is too thin to fit between the rafters. This invention can hold down a roof purlin and corrugated metal roofing using a simple embodiment.

Edges of the clip are slightly rounded for strength, ease of handling, and avoiding stress fracturing associated with sharp corners.

These and other objectives of the invention are achieved by simple and economical connectors that allow a builder or home owner to quickly and easily secure the weakest parts of a building against earth tremors and high winds.

Advantages of each will be discussed in the description. Further objects and advantages of my invention will become apparent from a consideration of the drawings and ensuing description.

Figure 1:
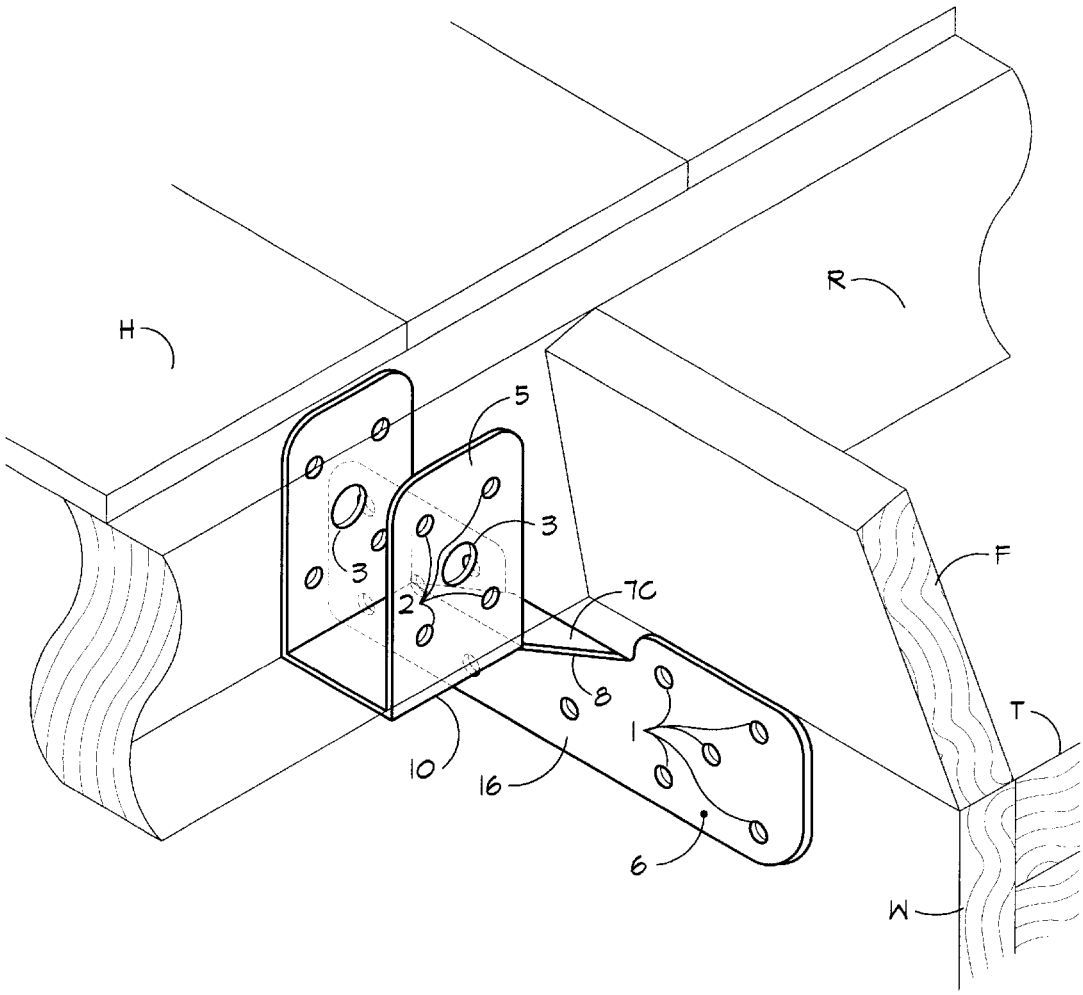
FIG. 1 is a perspective view of a stealth clip mounted on a house.
Figure 1A:
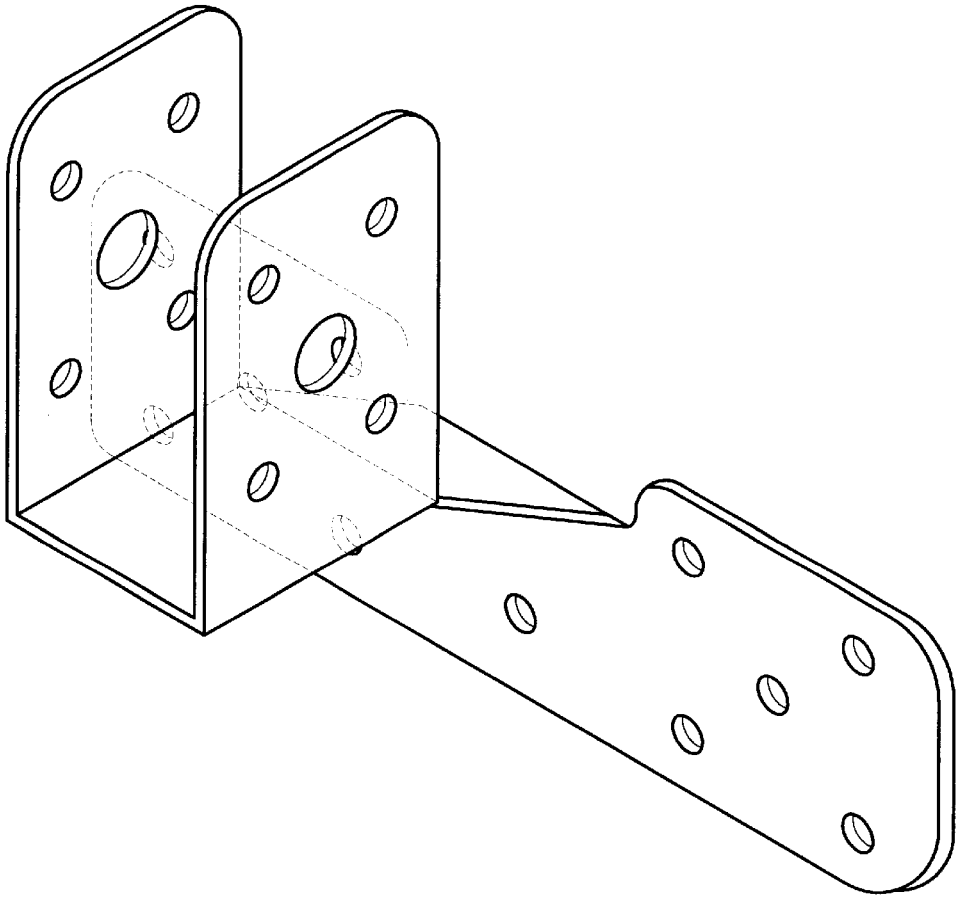
FIG. 1A is a perspective view of a stealth clip.

| | |
|---|---|
| 1. | Base nail holes |
| 2. | Web nail holes |
| 3. | Bolt holes |
| 4. | Stealth clip |
| 5. | Right rafter tab |
| 6. | Right base member |
| 7. | Rafter saddle |
| 7a. | Obtuse angle bend |
| 7b. | Rafter acute bend |
| 7c. | Wall acute bend |
| 8. | Right saddle arc |
| 9. | Left saddle arc |
| 10. | Right rafter bend |
| 11. | Left base member |
| 12. | Left rafter tab |
| 13. | Left rafter bend |
| 14. | Left notch |
| 15. | Right notch |
| 16. | Middle base member |
| 17. | Right nail expanse |
| 18. | Left nail expanse |
| 19. | Roof sheathing tie |
| 20. | Gusset |
| 21. | Roof butt |
| 22. | Bolt hole |
| 23. | Rafter fixture |
| 24. | Butt bend |
| 25. | Fold bend |
| 26. | Fixture nail holes |
| 27. | Roof U-bolt |
| 27a. | Bolt leg |
| 28. | Nut |
| 28a. | Washer |
| 29. | Corrugated strap |
| 30. | Long slot |
| 31. | Rubber gasket |
| 32. | Special washer |
| 33. | Bolt |
| 34. | Wall plate |
| 35. | Nail holes |
| 36. | Cut-out notch |
| 37. | Tab slot |

-continued

| | |
|---|---|
| 37a. | Slot tab |
| 38. | Rafter crib |
| 39. | Foundation bend |
| 40. | Foundation |
| 41. | Support bend |
| 42. | Frame |
| 43. | Hollow |
| 44. | Internal nut |
| 45. | Slotted plate |
| 45a. | Short slots |
| 46. | Stem |
| 47. | Domed head |
| 48. | Hex shape |
| 49. | Upsets |
| 50. | Hook |
| 51. | Bridle |
| 60. | ½ stealth clip |
| 61. | Wide base |
| 62. | Seat saddle |
| 63. | Seat saddle bend |
| 64. | Rafter member |
| 65. | Rafter member bend |
| 66. | Offset bend |
| 67. | Ramp |
| 68. | Single notch |
| 69. | Bottom stealth clip |
| R | Rafter |
| F | Frieze board |
| W | Outside wall sheathing |
| T | Top plate |
| H | Roof sheathing |
| M | Roofing material |

DESCRIPTION

The present invention is a sheet metal retrofit connector for joining wood members on a building, such as a roof rafter R and outside wall sheathing W. During a hurricane, it prevents the roof rafter R from disconnecting from the outside wall sheathing, W, and underlying top plate T by uplifting forces. The stealth clip 4 prevents the outside wall sheathing W from detaching or bowing in or out from pressure extremes during a hurricane.

The stealth clip 4 prevents detachment and sliding of the outside wall sheathing W from lateral forces during an earthquake. This clip makes the outside wall sheathing w into an extremely stable shear wall; and ties the top plate T and roof rafter R securely to this shear wall making a very strong shear wall, resistant to most earth tremors.

Besides these very important functions, the stealth clip 4 is a retrofit and is very easy to install on completed houses. The innovative top web clears frieze boards F, warped frieze boards, wires, and wood trim under the rafters, so no demolition is required.

The top web cradles the rafter on three sides, no matter what the slope is of the roof. The top web will also easily fit on rafters made up of roof trusses, glue lams, engineered wood I-beams, or metal beams. The top web is simple to attach to the rafter with nails or screws.

The bottom web is easily attached to the outside sheathing with nails or screws. The wide webs, on either side of the rafter provide plenty of room for hammering, hammer-gun, or electric screwdriver. If the outside walls are made of brick or masonry, holes can be marked, drilled with a carbide drill, and inserted with lead-type anchors. Common screws can then be used to install the bottom web.

Sheet metal connectors have been proven to perform better than nailed connections under stresses of strong winds and earth tremors. This invention is very easily installed on a pre-existing house without any disassembly or destruction of the house. Once installed, the house is much stronger than just nailed connections and more sturdy than prior art connectors that are installed during construction of a building.

The invention can be easily installed as a retrofit at the weakest connection of a house, during a hurricane, the rafter R to outside wall sheathing W. It can also be installed as a retrofit to the weakest connection of a house, during an earthquake, the wall stud S to floor joist J in a Permanent Wood Foundation.

FIG. 1

Refer now to FIG. 1, which shows a perspective view of a stealth clip 4 installed on the outside wall W of an existing house. In the preferred form of the invention, a left base member 11 and right base member 6 have nail holes 1 spaced to prevent wood splitting. The left base member 11 and right base member 6 are connected to each other by the middle base member 16 and are mostly flat, wide, and parallel to each other.

Two vertical slots form generally parallel notches that divide the base member into approximate thirds. The left third is the left base member 11, the right third is the right base member 6, and the middle third is the middle base member 16. The left notch 14 is generally perpendicular to the long dimension of the base member, as is the right notch 15. The left and right notches 14 and 15 are cut generally less than half-way through the base member.

The left side of the left notch 14 furnishes the left nail expanse 16, at the top part of the left base member 11, including base nail holes 1. The right side of the right notch 15 furnishes the right nail expanse 17, at the top part of the right base member 6, including base nail holes 1. These base nail holes 1 provide nailing into the top 2× of the top plate T.

The right part of the left notch 14 forms the left saddle arc 9, and the left part of the right notch 15 forms the right saddle arc 8. Bending, by sheet metal methods, occurs generally perpendicular to, and between, the left notch 14 and right notch 15. The generally obtuse-angle-bend 7*a* droops the rafter saddle 7 down and toward the middle base member 16.

The rafter saddle 7 is generally flat, forming a cradle for the bottom part of the rafter. The rafter saddle 7 has right-angle bends at either side. The distance between both right-angle bends is the approximate thickness of a 2×, usually 1½ inches. The left rafter bend 13, is a generally right-angle bend that is bent upward forming a left rafter tab 12, on the left side. The right rafter bend 10, is a generally right-angle bend that is bent upward forming a right rafter tab 5, on the right side.

The left rafter tab 12 has web nail holes 2 that are offset from web nail holes 2 on the right rafter tab 5. The offset web nail holes 2 prevent the rafter from splitting. A bolt hole 3 is at the approximate same location on the right rafter tab 5 and left rafter tab 12 so a bolt can be driven through from either side for additional strength. Edges of the clip 4 are slightly rounded for strength, ease of handling, and avoiding stress fracturing associated with sharp corners.

Installation of the stealth clip 4 on an existing house is simple. The stealth clip 4 is slid up under where the rafter sticks out from the house. The left rafter tab 12 is on the left side of the rafter R, and the right rafter tab 5 is on the right side of the rafter R. The stealth clip 4 is slid up until the rafter saddle 7 seats against the bottom part of the rafter R, while the right base member 6, left base member 11, and middle base member 16 are snug against the outside wall W.

In this position, the stealth clip 4 can be secured to the rafter R and outside wall W. Nails or screws can be utilized with hand or power tools.

Nails driven through the base nail holes 1 will penetrate the outside wall sheathing W and imbed inside the underlying top plate T. These nails securely tie the outside wall sheathing W to the underlying top plate.

The wide area of the right base member 6, left base member 11, and middle base member 16 forms a large washer that helps keep the outside wall sheathing W from splintering, cracking, or splitting. The right base member 6 and left base member 11 are widely offset to either side of the rafter saddle 7 so nails can be hammered in the base nail holes 1 without interference from the rafter R.

With the right base member 6, left base member 11, and middle base member 16 secured to the outside wall sheathing W, the left rafter tab 12 and right rafter tab 5 clear frieze boards F, warped frieze boards, and wires. Nails can be driven into the web nail holes 2 of the right rafter tab 5 and left rafter tab 12, and into the wide side of the rafter R. The roof rafter R is now securely connected to the outside wall W and the underlying top plate T.

Since outside wall sheathing is routinely nailed to two or more wall studs S, and the wall studs S are commonly connected to the sill plate P, the rafters R and top plate T now have a continuous load path to the foundation.

FIG. 2

Figure 2:
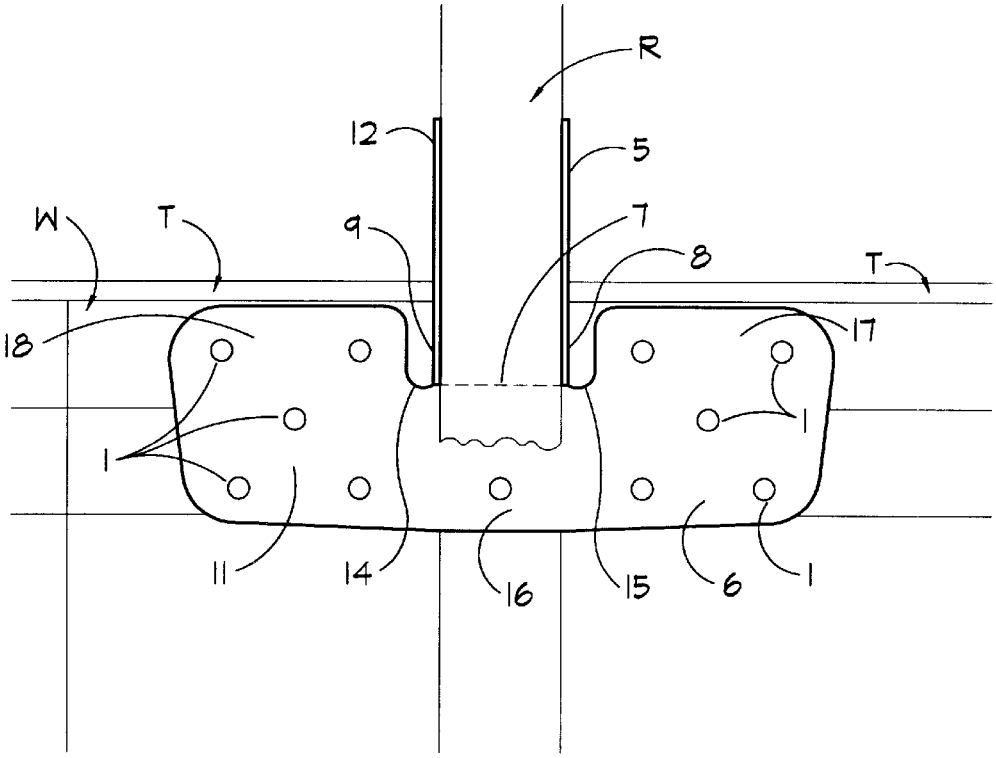
FIG. 2 is a front view of a stealth clip.

Refer now to FIG. 2, which shows a front view of a stealth clip 4 installed on the outside wall W of an existing house. The left base member 11 and right base member 6 have nail holes 1 spaced to prevent splitting the outside wall sheathing W and underlying top plate T.

The left base member 11 and right base member 6 are connected to each other by the middle base member 16 and are mostly flat, wide, and parallel to each other. This view shows how much surface area of the outside wall sheathing the base members cover. This view also shows that the rafter will not interfere with hammering nails into the base nail holes 1.

This view shows the two vertical slots that form generally parallel notches that divide the base member into approximate thirds. The left third is the left base member 11, the right third is the right base member 6, and the middle third is the middle base member 16. The left notch 14 is generally perpendicular to the long dimension of the base member, as is the right notch 15. The left and right notches 14 and 15 are cut generally less than half-way through the base member.

The left side of the left notch 14 furnishes the left nail expanse 18, at the top part of the left base member 11, including base nail holes 1. The right side of the right notch 15 furnishes the right nail expanse 17, at the top part of the right base member 6, including base nail holes 1. These base nail holes 1 provide nailing into the top 2× of the top plate T.

The right part of the left notch 14 forms the left saddle arc 9, and the left part of the right notch 15 forms the right saddle arc 8. The generally obtuse-angle-bend 7*a* droops the rafter saddle 7 down and toward the middle base member 16. The obtuse-angle-bend 7*a*, allows the attached rafter tabs to be angled away from vertical.

The rafter saddle 7, seen head on, is generally flat, forming a cradle for the bottom part of the rafter. The rafter saddle 7 has right-angle bends at either side. The left rafter bend 13, is a generally right-angle bend that is bent upward forming a left rafter tab 12, on the left side. The right rafter bend 10, is a generally right-angle bend that is bent upward forming a right rafter tab 5, on the right side.

The distance between both right-angle bends is the approximate thickness of a 2×, usually 1½ inches, so that the rafter fits between the right rafter tab 5 and left rafter tab 12, and bottoms on the rafter saddle 7.

This view shows how the right nail expanse 17 and the left nail expanse 18 will hinder uplift of the rafter R. When wind tries to lift up the rafter R, the wide area of the right nail expanse 17 and the left nail expanse 18 prevents moment-arm force, or pushing of the right nail expanse 17 and the left nail expanse 18 into the sheathing and underlying top plate.

This view shows how the stealth clip 4 makes the rafter R to outside wall sheathing W and underlying top plate T connection so secure, that the outside wall sheathing W becomes a strong shear wall. With the stealth clip 4 installed on a house, the outside wall can dissipate any ground movements to the roof, and back to the foundation, without becoming disconnected.

In California, many houses are constructed with a permanent wood foundation, utilizing a crawlspace. During earthquakes, the top plate of the foundation wall disconnects from the stud wall and floor joist. The stealth clip 4 can be retrofit at this connection by crawling into the crawlspace.

Long thin strips of plywood can be installed on the top plate and top part of the wall stud. This will tie the studs together with the top plate. A Stealth clip 4 is then installed. FIG. 2 shows how the left base member 11 and right base member 6 would be on the installed plywood and underlying top plate T.

The left rafter tab 12 and right rafter tab 5 would be installed on the floor joist, just like on a rafter R. This prevents the floor joist, top plate, and stud from disconnecting, as the stealth clip 4 prevents lateral movement in an earthquake.

FIG. 3

Figure 3:
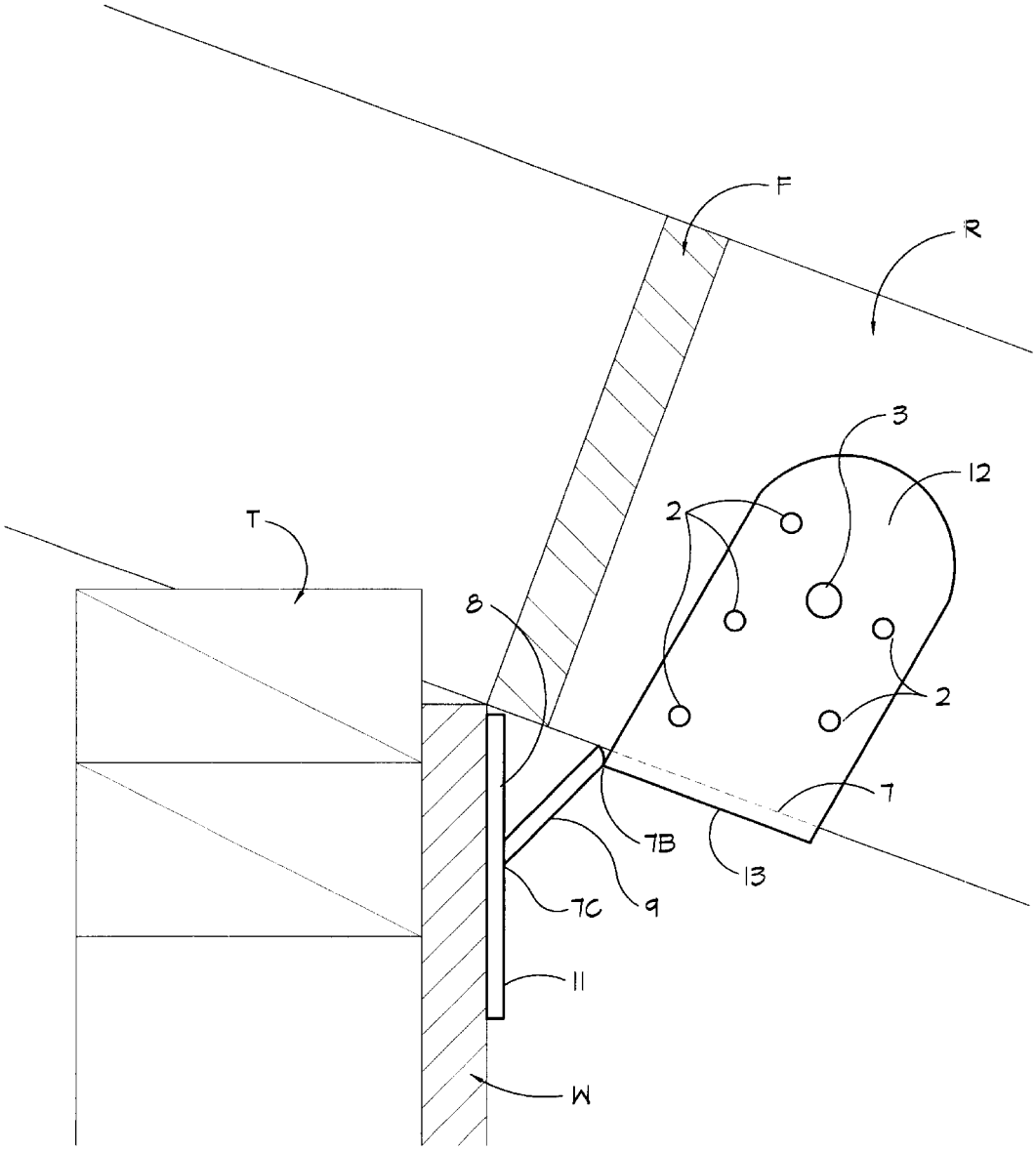
FIG. 3 is a side view of a stealth clip.

Refer now to FIG. 3 which shows a left side view of a stealth clip 4 installed on an existing house. Although the stealth clip 4 could be installed during construction, by retro-fitting, the outside wall sheathing W is tightly secured to the rafter R and underlying top plate T. This makes a house much more resistant to hurricanes and earthquakes.

In FIG. 3, the left rafter tab 12 is shown attached to the left side of a roof rafter R, with nails driven through the web nail holes 2. The left rafter bend 13 is at the bottom edge of the left rafter tab 12.

The left rafter tab 12 has web nail holes 2 that are offset from web nail holes 2 on the right rafter tab 5. The offset web nail holes 2 prevent the rafter from splitting. A bolt hole 3 is at the approximate same location on the right rafter tab 5 and left rafter tab 12 so a bolt can be driven through from either side for additional strength.

The length of the left rafter tab 12 can be seen preventing the rafter R from splitting in the long dimension, if uplifting forces from high winds try and lift the rafter R. Even if the wind forces were strong enough to split the rafter R lengthwise, it would still hold together because of the nails and wide surface area of the left rafter tab 12.

FIG. 3 shows the rafter acute bend 7*b*, the wall acute bend 7*c*, and left saddle arc 9 in profile. The wall acute bend 7*c* places the left saddle arc 9 and rafter acute bend 7*b* away from the outside wall sheathing W. The rafter acute bend 7*b* locates the rafter saddle 7 under the rafter R.

The wall acute bend 7*c* locates the left saddle arc 9 away from wires, wood trim, and the frieze board F. The rafter acute bend 7*b* locates the left rafter tab 12 away from frieze boards F, warped frieze boards, and mis-placed frieze boards.

FIG. 3 also shows the upside-down shape of a flying buttress. The left rafter tab 12 forms the foundation and the left saddle arc 9 forms the brace to keep the left base member 11 and underlying outside wall sheathing W secure to the wall and rafter R.

The rafter bird's mouth helps prevent the rafter R from moving toward the inside of the house, but does not prevent the wall W from moving toward the house or the rafter R from moving away from the house. The stealth clip 4 forms an upside-down flying buttress that prevents the rafter from moving in or out. It also prevents the wall from moving in or out. The roof and wall will now move and absorb forces as one unit.

FIG. 4

Figure 4:
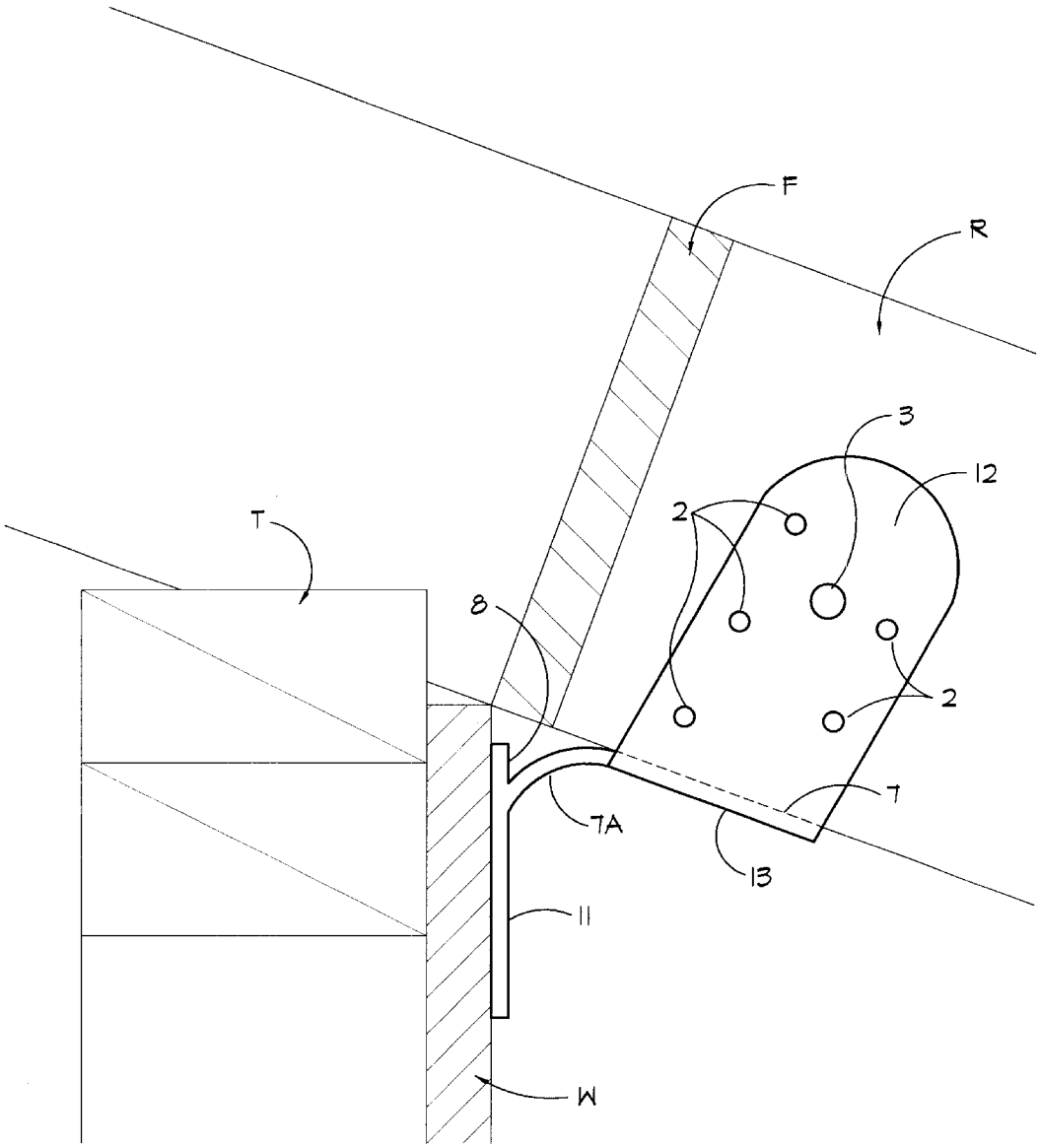
FIG. 4 is a side view of a stealth clip.

Refer now to FIG. 4 which shows a side view of an embodiment of the stealth clip 4. Since the rafter saddle 7 does not bear any weight, the rafter acute bend 7*b* and wall acute bend 7*c*, of FIG. 3, could be combined into a single obtuse-angle-bend 7*a*.

This embodiment has no other changes except for the obtuse-angle-bend 7*a* between the left rafter tab 12 and left base member 11. Some architects and homeowners may prefer the stealth clip 4 with an obtuse-angle bend 7*a*, instead of the rafter acute bend 7*b* and wall acute bend 7*c*.

FIG. 5

Figure 5:
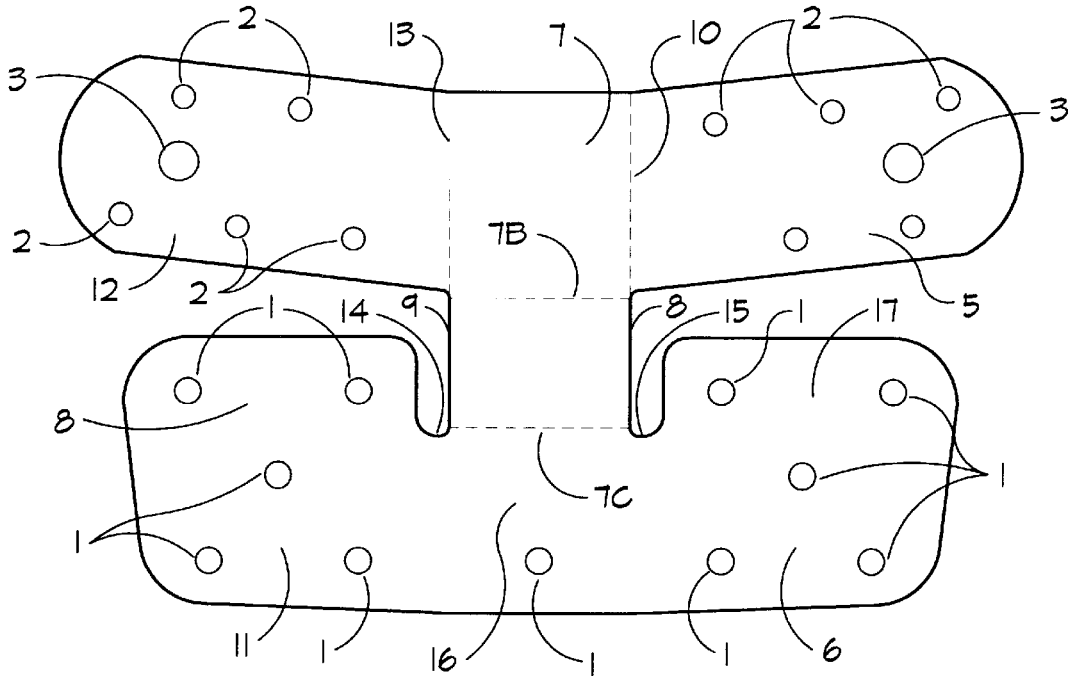
FIG. 5 is a flat pattern layout of a stealth clip.

Refer now to FIG. 5 which shows a flat-pattern layout of a stealth clip 4. In the preferred form of the invention, a left base member 11 and right base member 6 have nail holes 1 spaced to prevent wood splitting. The left base member 11 and right base member 6 are connected to each other by the middle base member 16 and are mostly flat, wide, and parallel to each other.

Two vertical slots form parallel notches that divide the base member into approximate thirds. The left third is the left base member 11, the right third is the right base member 6, and the middle third is the middle base member 16. The left notch 14 is perpendicular to the long dimension of the base member, as is the right notch 15. The left and right notches 14 and 15 are cut generally less than half-way through the base member.

The left side of the left notch 14 furnishes the left nail expanse 16, at the top part of the left base member 11, including base nail holes 1. The right side of the right notch 15 furnishes the right nail expanse 17, at the top part of the right base member 6, including base nail holes 1. These base nail holes 1 provide nailing into the top 2× of the top plate T.

The right part of the left notch 14 forms the left saddle arc 9, and the left part of the right notch 15 forms the right saddle arc 8. Bending, by sheet metal methods, occurs generally perpendicular to, and between, the left notch 14 and right notch 15. The generally obtuse-angle-bend 7*a* droops the rafter saddle 7 down and toward the middle base member 16.

The rafter saddle 7 is generally flat, forming a cradle for the bottom part of the rafter. The rafter saddle 7 has right-angle bends at either side. The distance between both right-angle bends is the approximate thickness of a 2×, usually 1½ inches, but this distance can be changed to meet different size rafters. The left rafter bend 13, is a generally right-angle bend that is bent upward forming a left rafter tab 12, on the left side. The right rafter bend 10, is a generally right-angle bend that is bent upward forming a right rafter tab 5, on the right side.

The left rafter tab 12 has web nail holes 2 that are offset from web nail holes 2 on the right rafter tab 5. The offset web nail holes 2 prevent the rafter from splitting. A bolt hole 3 is at the approximate same location on the right rafter tab 5 and left rafter tab 12 so a bolt can be driven through from either side for additional strength. Edges of the clip 4 are slightly rounded for strength, ease of handling, and avoiding stress fracturing associated with sharp corners.

FIG. 6

Figure 6:
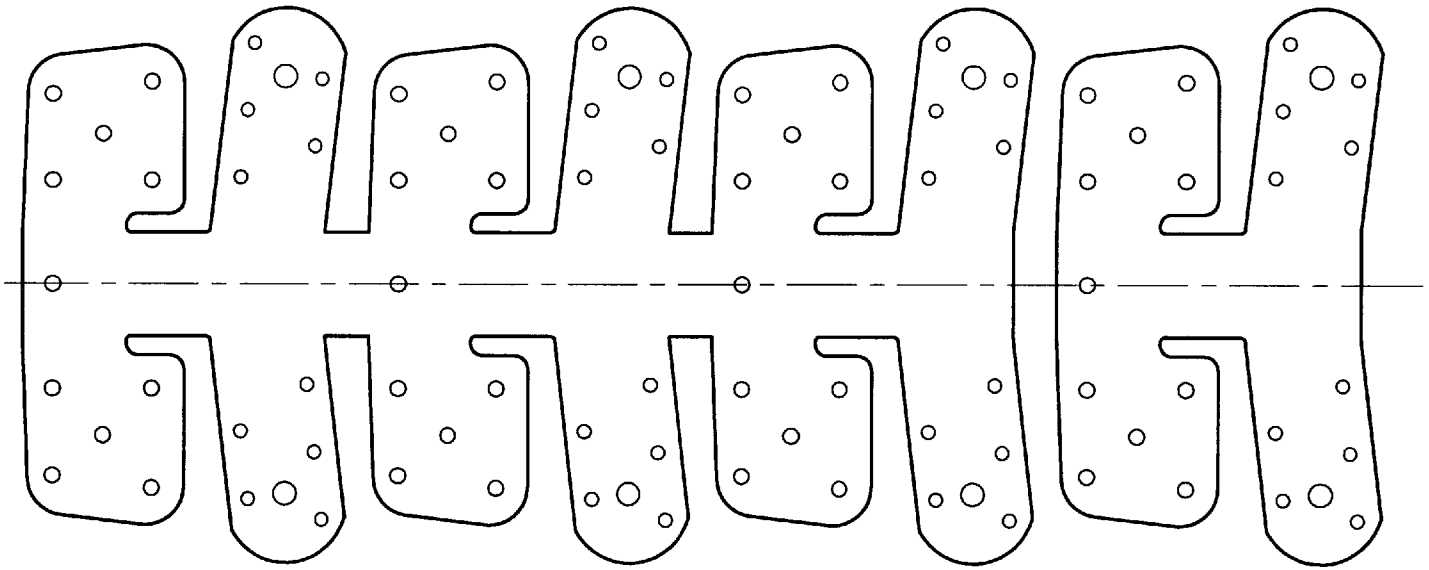
FIG. 6 is a flat pattern layout for machine feeding.

Refer now to FIG. 6 which shows a flat-pattern layout of a stealth clip 4 prior to bending. This view shows that there is very little waste when punching out the stealth clip 4 by progressive die methods. Each stealth clip "nests" by each other so there is little waste of metal when formed. The feed direction is as shown.

FIG. 7

The rafter to top plate junction is the weakest connection on a house, and installation of the stealth clip 4 will lock together this vital junction.

The roof sheathing and roofing material are also important structural members of a house, but were weakly installed on some houses. Staples were used to attach the plywood or OSB sheathing to the rafters, and are still permissible in some areas. Staples have been shown to quickly rust away in wet climates.

Staples don't penetrate deeply into the rafter, but even nails miss the rafter. The newer air guns can completely miss the underlying rafter and the installer would not know it because of the same feel on the gun of going into wood or into air. Some air guns are set too high, where the nail is shot too fast and penetrates through the thin veneer of the plywood or almost completely through the OSB. Once the veneer is damaged, the holding power is significantly reduced.

A homeowner can secure the roof sheathing H and roofing material M at the same time as he/she is securing the rafter R, outside sheathing W, and top plate T connection with the stealth clip 4. A simple embodiment can be used to tie down the roof sheathing and roofing material, and would also make the house much more resistant to hurricanes and earthquakes.

Figure 7:
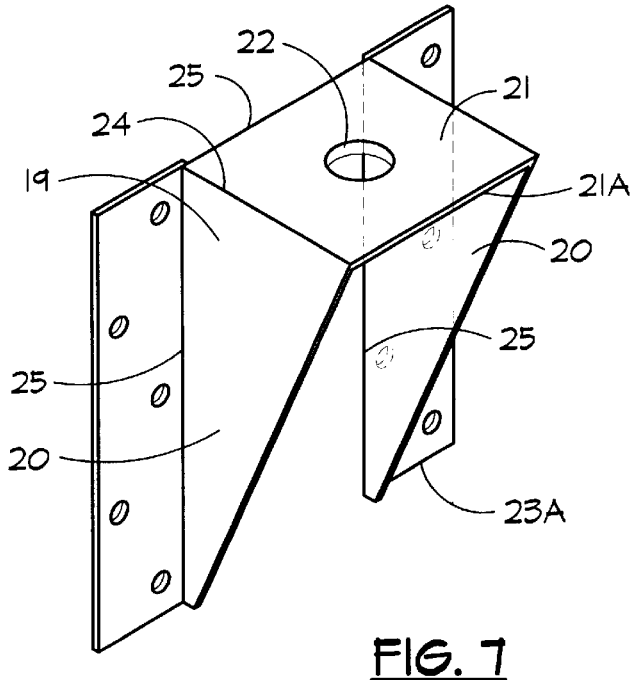
FIG. 7 is a perspective view of a retrofit roof sheathing tie.

Refer now to FIG. 7 which shows a perspective view of a retrofit roof sheathing tie 19. The tie consists of a flat roof butt 21 with an bolt hole 22. The roof butt 21 has an open end 21*a* on one side. Adjacent to both sides of the open end 21*a* are generally right-angle butt bends 24.

The butt bends 24 have gussets 20 attached. The gussets 20 are on either side, and perpendicular to the roof butt 21. The gussets 20 are triangular-shaped for rigidity, with the hypotenuse-edge open. A generally right-angle fold bend 25, at the side adjacent to the butt bend 24, forms a rafter fixture 23.

The rafter fixtures 23 are generally rectangular-shaped with fixture nail holes 26. The long open edges 23*a* of the rafter fixtures 23 butt up against each other forming a flat tract that is perpendicular to the roof butt 21 and perpendicular to the gussets 20.

The roof sheathing tie 19 is shaped like a truncated, rectangular box, with the box cut in half along the long diagonal dimension. The box is a strong design, and is now open on two sides and along part of the diagonal, allowing for easy installation.

The rafter fixtures 23 could also be bent out at right-angles, away from each other, and still form a flat tract. The box is then open on three sides. This may not be as strong as when the rafter fixtures 23 are folded in and the long open edges 23*a* butt up against each other, but it is another embodiment.

FIG. 8

Figure 8:
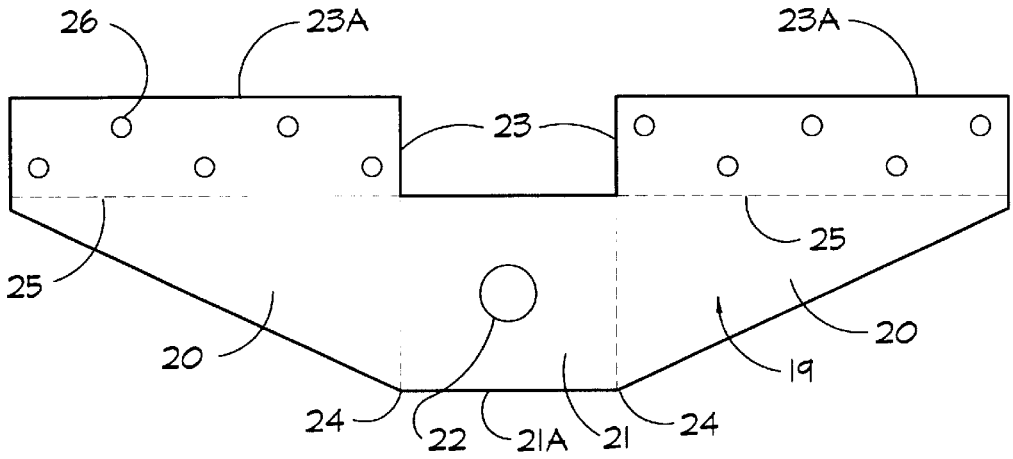
FIG. 8 is a flat pattern layout of a roof sheathing tie.

Refer now to FIG. 8 which shows a flat-pattern layout of a roof sheathing tie 19. The tie consists of a flat roof butt 21 with a bolt hole 22. The bolt hole 22 is spaced about ¾ inch from the fold bend 25. The roof butt 21 has one open end 21a. Adjacent to both sides of the open end 21a are right-angle butt bends 24.

The butt bends 24 have gussets 20 attached. The gussets 20 are on either side, and are formed perpendicular to the roof butt 21. The gussets 20 are triangular-shaped for rigidity, with the hypotenuse-edge open. A right-angle fold bend 25, at the side adjacent to the butt bend 24, forms a rafter fixtures 23.

The rafter fixtures 23 are generally rectangular-shaped with fixture nail holes 26. The long open edges 23*a* of the rafter fixtures 23 butt up against each other after forming, making a flat tract that is perpendicular to the roof butt 21 and perpendicular to the gussets 20.

FIG. 9

Figure 9:
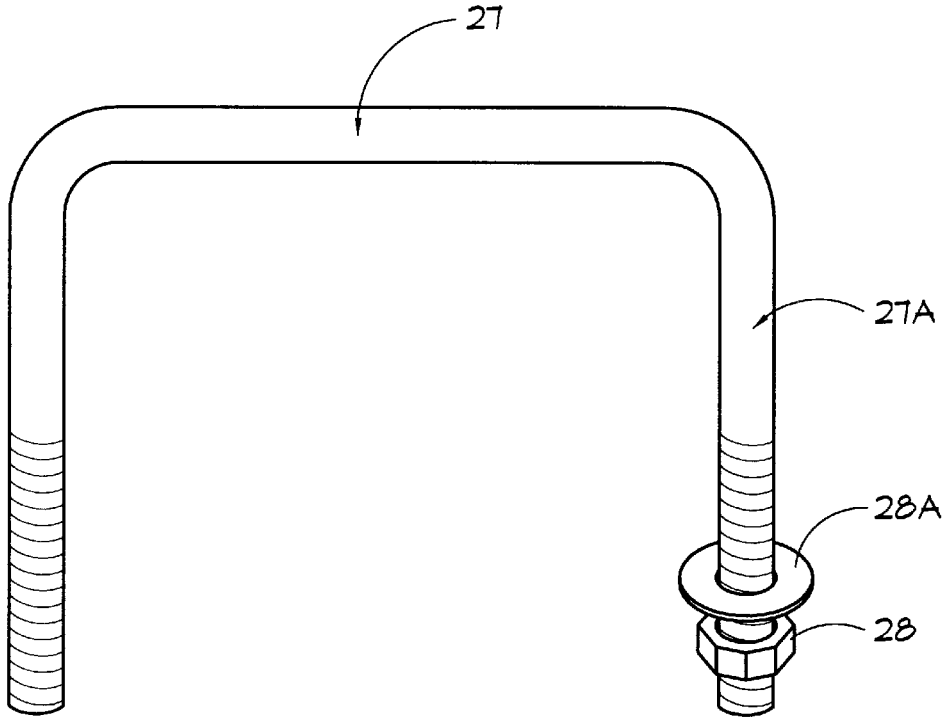
FIG. 9 is a front view of a roof U-bolt.

Refer now to FIG. 9 which shows a front view of a roof U-bolt 27. The roof U-bolt 27 is a simple U-shaped bolt with bolt legs 27*a* that are set apart about 3 inches. This distance is larger than the thickness of a roof rafter R, usually 1½ inches, to make room for a nut 28 and washer 28*a*, when mounted on the roof, and straddling a rafter R.

The bolt legs, 27*a* are preferably about ⅝ inch diameter for strength, and threaded along most of the length. The roof U-bolt 27 is made by standard methods, such as cold rolled, formed, and threaded. The length of the bolt legs 27*a* is not critical even if the rafters are trusses, 2×4's, 2×6's, or 2×8's since the bolt legs 27*a* go through the roof sheathing H and roofing material M.

FIG. 10

Figure 10:
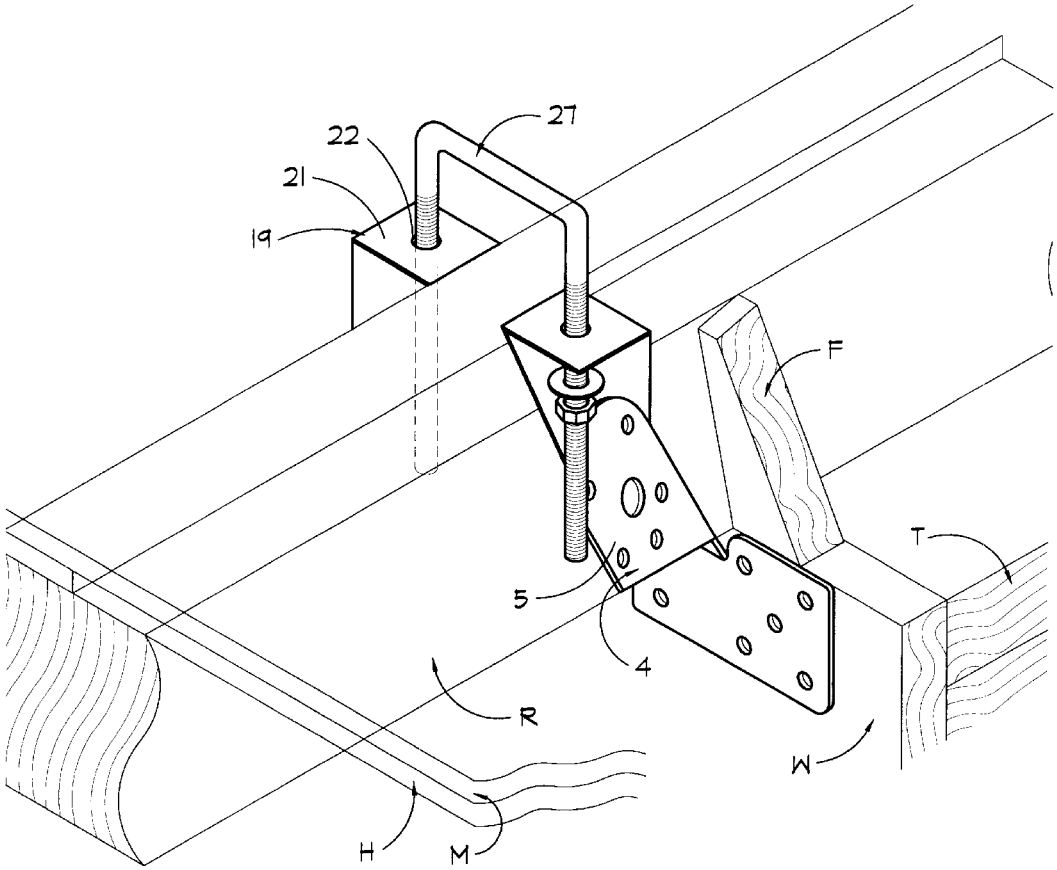
FIG. 10 is a perspective view of a roof sheathing tie.

Refer now to FIG. 10 which shows a roof sheathing tie 19, roof U-bolt 27, and stealth clip 4 securing the roof to the outside wall. Installation of the roof sheathing tie 19 and roof U-bolt 27 is more complicated than installing the stealth clip 4, since holes must be drilled into the roof. But since the drilling is performed underneath the roof and outside the house, safety is maintained and there should be no rain leaks inside the house, but a rubber washer can be used around the bolt legs 27*a*.

Installation of the roof sheathing tie 19 can be performed before, during, or after a stealth clip 4 is installed, but preferably, both should be installed at the same time.

A roof sheathing tie 19 is placed above the right rafter tab 5 and pushed to the top of the rafter R, and nailed to the rafter. The roof butt 21 is now firmly underneath the bottom part of the roof. The bolt hole 22 is marked and drilled up through the roof sheathing H and roofing material M. The same is done on both sides of the rafter R.

Then a roof U-bolt 27 is dropped down from the top of the roof. The bolt legs 27*a* are passed through the drilled holes in the roofing material M and roof sheathing H, and through the bolt holes 22 on the roof butts 21.

A washer 28*a* and nut 28 are threaded up the bolt leg 27*a* and tightened against the bottom of the roof butt 21. The roofing material M and roof sheathing H are now tightly secured to the rafter R, outside sheathing W, and underlying top plate T.

FIG. 11

Figure 11:
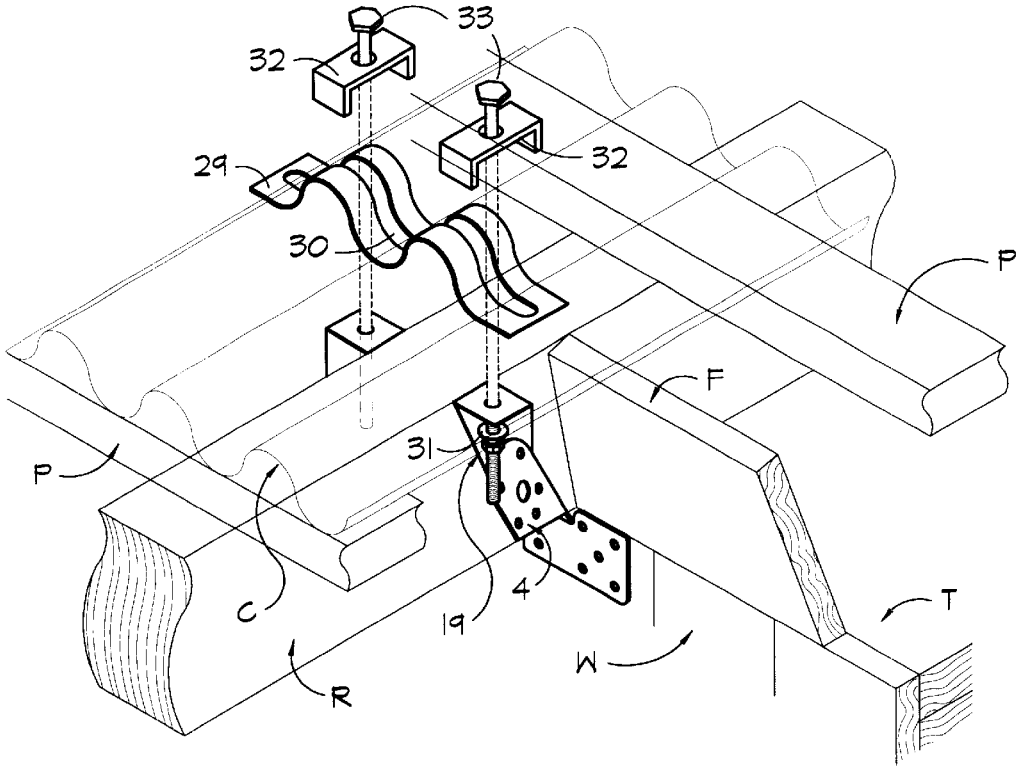
FIG. 11 is a perspective view of a corrugated strap.

Refer now to FIG. 11 which shows a perspective view of a house roof that is very common in tropical climates where rain and sun can ruin a standard roof in several years. The roofing material is thin corrugated steel that comes in long narrow sheets. The corrugated steel roofing C is too narrow to bridge normal roof rafters R, so perpendicular strips of wood, called purlins P bridge the rafters. R and provide nailing for the corrugated steel roofing C.

By using the same roof sheathing tie 19, a corrugated strap 29 can be used to tie the corrugated steel roofing C to the purlin P and roof rafter R. The corrugated strap 29 has a wavy profile similar to the contour of standard corrugated steel roofing C.

The length of the corrugated strap 29 is about twice the width of a standard rafter. A long slot 30 runs most of the inside length of the corrugated strap 29. This long slot allows a bolt, about ⅝ inch-diameter to enter. The corrugated strap 29 is formed by standard metal forming methods.

Installation of the roof sheathing tie 19 is as described above. Since the corrugated steel roofing C is attached to the purlins P, a hill or valley of the corrugation may be over the rafter R. Holes are drilled through the bolt holes 22 of the roof sheathing tie 19, and up through the roof and corrugated steel roofing C. These drilled holes may lie in a hill or valley of the corrugations, or on the slopes.

The corrugated strap 29 is laid over the drilled holes, conforming with the hills and valleys. The long slot 30 of the corrugated strap 29 is long enough so that no matter where the hills and valleys lie over the rafter R, bolts 33 will be able to go through the long slot 30 and through the bolt holes 22 of the roof sheathing tie 19. A rubber gasket 31, shaped like a rubber washer, is used around the bolt 33 to keep out rain.

Special washers 32 are used on top of the corrugated strap 29. The bottom part has four sides; opposite sides are curved down to conform with the valleys of a corrugation. The other opposite sides are curved up to conform with the hills of a corrugation. For hill slope, two special washers. 32 can be stacked to make a level surface. This way only one special washer 32 has to be manufactured by standard metal forming methods.

Bolts 33 are placed through the special washers 32, the long slot 30, the bolt hole 22, and secured with a washer 28*a* and nut 28. A rubber gasket or o-ring can be placed on the bolt first, to keep the roof waterproof. Tightening the nut 28 and bolt 33 secures the corrugated steel roofing C tightly to the purlin P and rafter R. The stealth clip 4 ties the rafter R to the outside sheathing W and underlying top plate T.

FIG. 12

Figure 12:
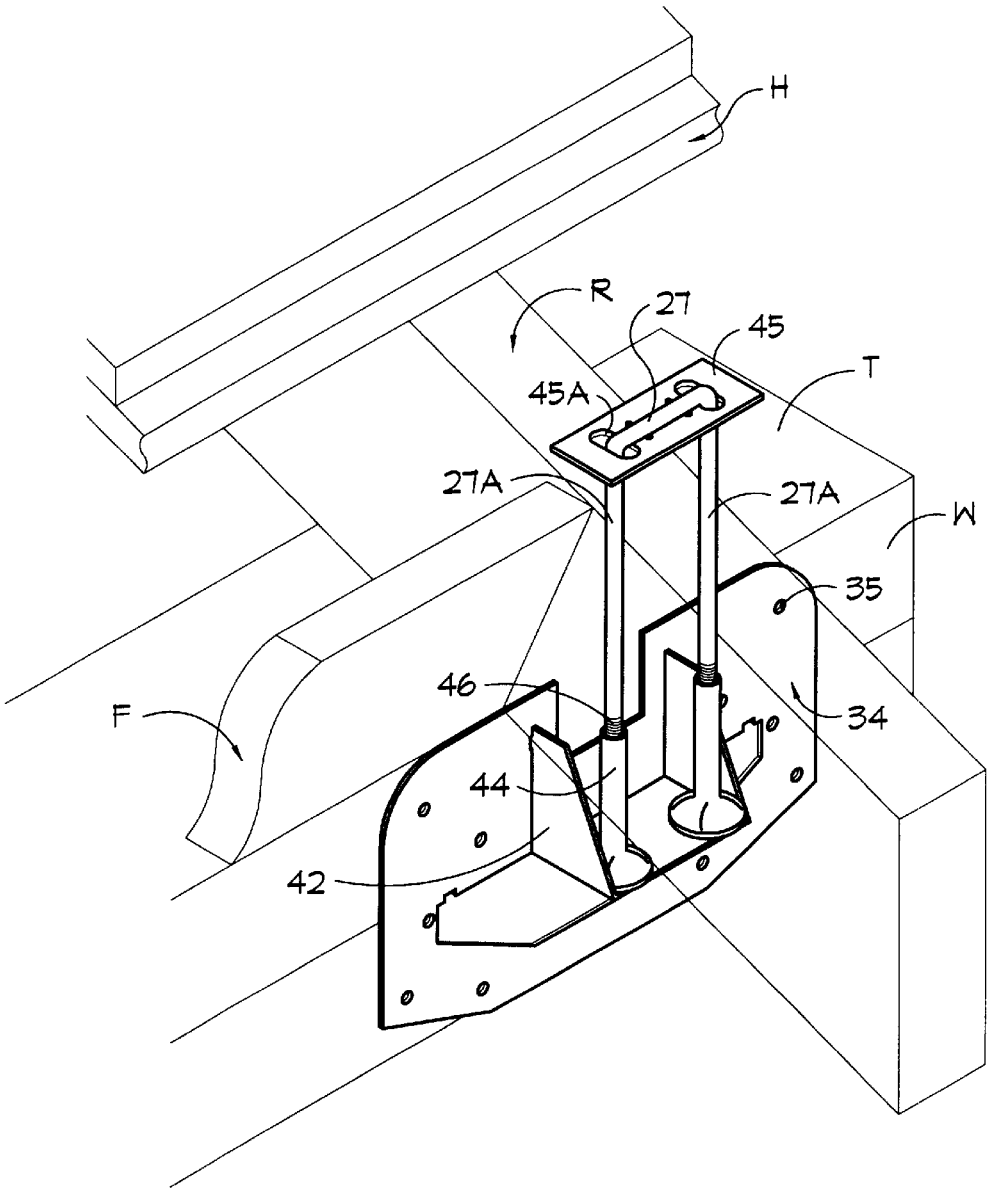
FIG. 12 is a perspective view of a wall plate on a house.

Refer now to FIG. 12 which shows another embodiment of a tie for the roof and wall, installed on an existing house. Above the roofing material M, is a roof U-bolt 27, described earlier, holding down the roofing material M and roof sheathing H.

Underneath the roof U-bolt 27 is a slotted plate 45, with short slots 45*a*. The rectangular slotted plate 45 lays flat on the roofing material M, and the short slots 45*a* allow the roof U-bolt 27 to stay mostly vertical. The slotted plate 45 allows the roof U-bolt 27 to be used with a wall plate 34 on different slopes of roof.

The wall plate 34, installed below the rafter R, is a wide, flat sheet with nail holes 35 and a cut-out notch 36 on the top. The nail holes 35 are for fasteners that are driven,into the outside wall sheathing W and underlying top plate T.

The cut-out notch 36 is about 3 inches square. This allows room for the rafter R to be cradled and for the bolt legs 27*a*, of the roof U-bolt 27, to straddle the rafter R. Surrounding the rafter R and bolt legs 27*a* is the crib 38.

The crib 38 is partially punched out and bent up, from the middle part of the wall plate 34, at the foundation bend 39. The foundation 40 is attached to the wall plate 34 at the foundation bend 39. Two perpendicular bends, the support bends 41, are bent first at approximately right angles from the foundation 40.

The support bends 41 form frames 42 on either side of the foundation 40. When the foundation bend 39 is formed at a right angle, the slot tabs 37*a*, on the frames 42, fit into the tab slots 37 on the wall plate 34. The slot tabs 37*a* make for a very strong link between the frame 42 on the rafter crib 38 and wall plate 34.

Hollows 43 are on the foundation 40. The hollows 43 are holes that are punched up and out forming dimples, with holes in the middle. The hollows 43 are the approximate same distance apart as the bolt legs 27*a* of a roof U-bolt 27.

An internal nut 44 is used to tighten the roof U-bolt 27 down to the foundation 40. The internal nut 44 is shaped like an intake valve on a car. The stem 46 is hollow and machined with threads. The threads receive the treads on the bolt leg 27*a* of the roof U-bolt 27.

The internal nut 44 is inserted through the hole in the hollow 43 and screwed onto the threads of the bolt leg 27*a*. As the internal nut 44 is tightened, the domed head 47, on the end of the internal nut 44, nests into the similar-shaped hollow 44. An allen wrench, inserted into the hex shape 48, at the bottom of the internal nut 44 screws the internal nut 44 tight.

The domed head 47 and hollow 43 allow for some degree of roof slope that is not compensated by the slotted plate 45.

FIG. 12A

Figure 12A:
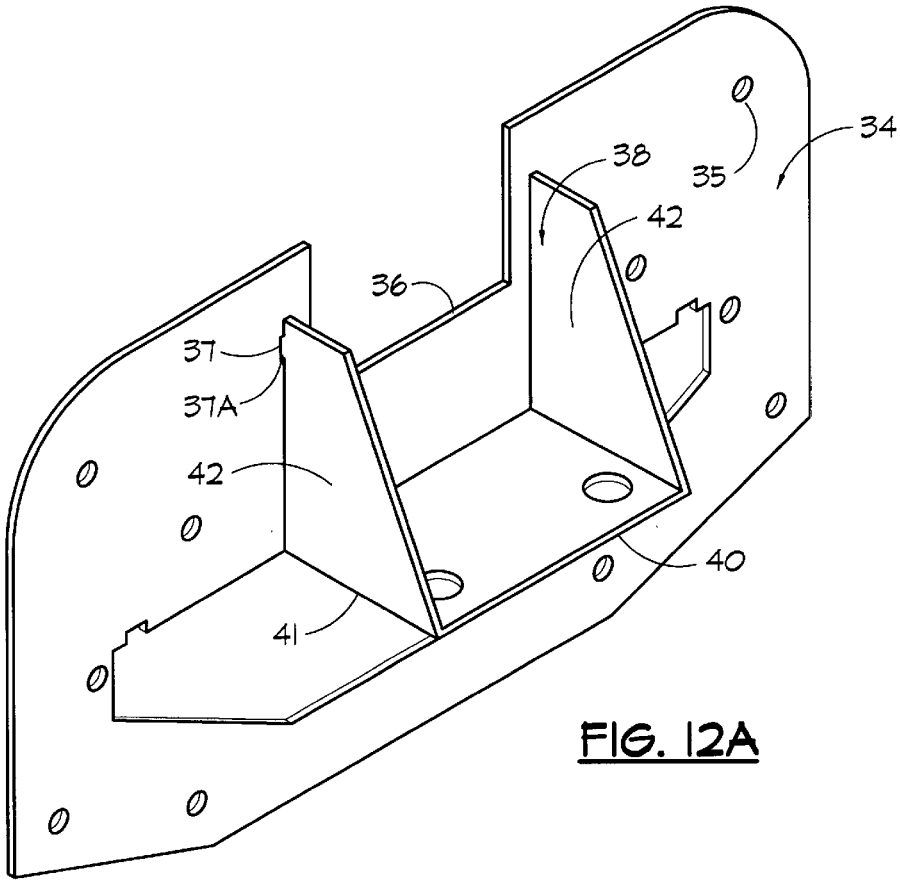
FIG. 12A is a flat pattern layout of a wall plate.

Standard metal-forming methods are used. Refer now to FIG. 12A which shows a flat pattern layout for a wall plate 34 before bending. The wall plate 34 is a wide, flat sheet with nail holes 35 and a cut-out notch 36 on the top. The cut-out notch 36 is about 3 inches square. Below the cut-out notch 36 is the crib 38.

FIG. 12B

Figure 12B:
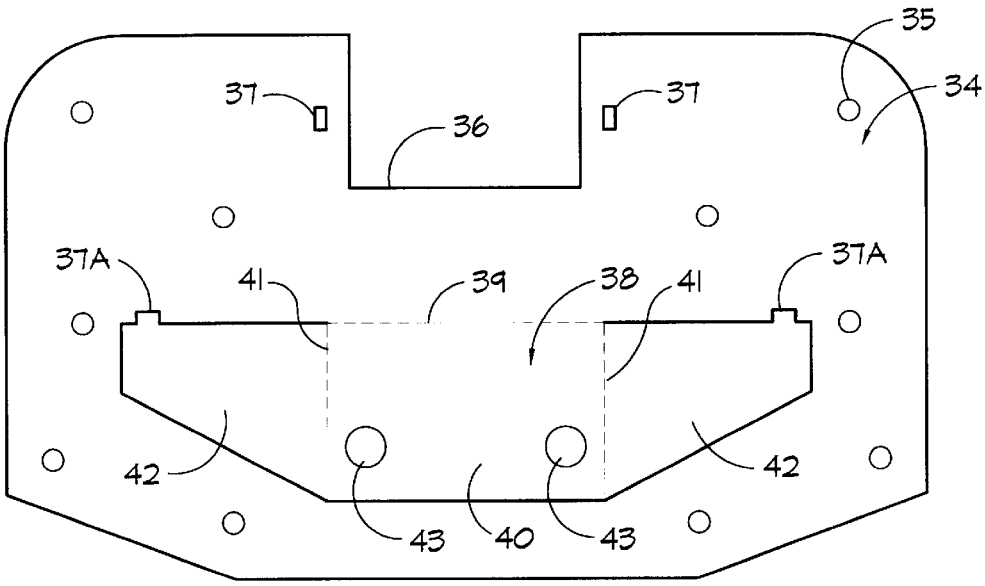
FIG. 12B is a perspective view of a wall plate.

Refer now to FIG. 12B which shows the crib 38 partially punched out and bent up, from the middle part of the wall plate 34, at the foundation bend 39. The foundation 40 is attached to the wall plate 34 at the foundation bend 39. Two perpendicular bends, the support bends 41, are bent first at approximately right angles from the foundation 40.

The support bends 41 form frames 42 on either side of the foundation 40. When the foundation bend 39 is formed at a right angle, the slot tabs 37*a*, on the frames 42, fit into the tab slots 37 on the wall plate 34. The slot tabs 37*a* make for a very strong link between the frame 42 on the rafter crib 38 and wall plate 34.

Hollows 43 are on the foundation 40. The hollows 43 are holes that are punched up and out forming dimples, with holes in the middle. The hollows 43 are the approximate same distance apart as the bolt legs 27*a* of a roof U-bolt 27.

Installing the wall plate 34, roof U-bolt 27, and internal nut 44 ties the roofing material M, roof sheathing H, rafter R, outside wall sheathing w, and underlying top plate T tightly together.

Figure 13:
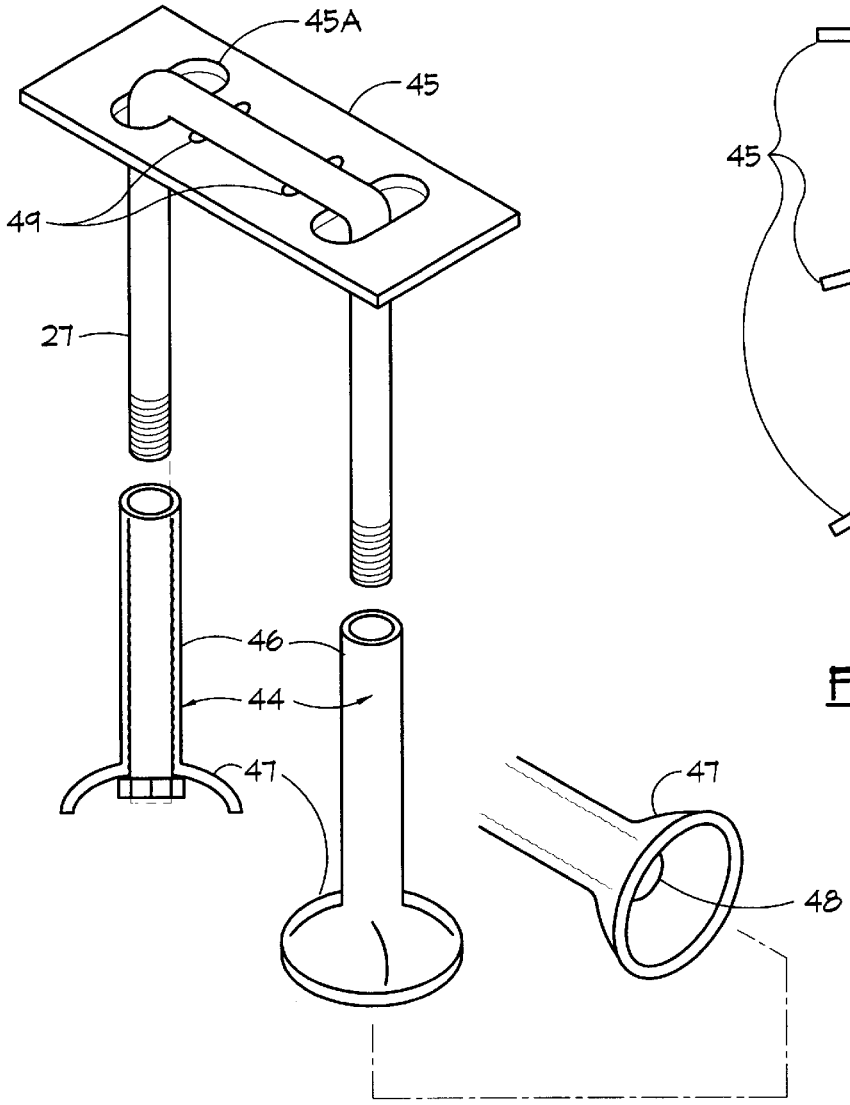
FIG. 13 is a perspective view of a U-bolt and flat plate.
Figure 14:
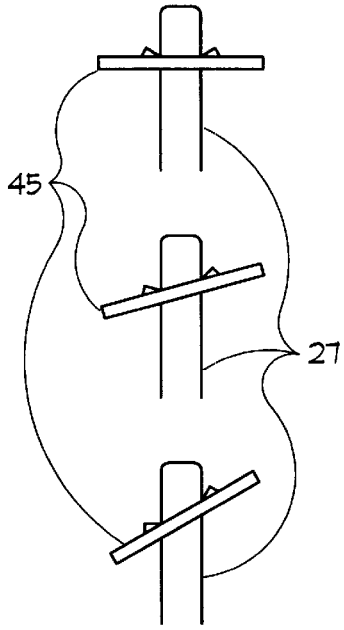
FIG. 14 is a side view showing various angles for roof pitch.
Figure 15:
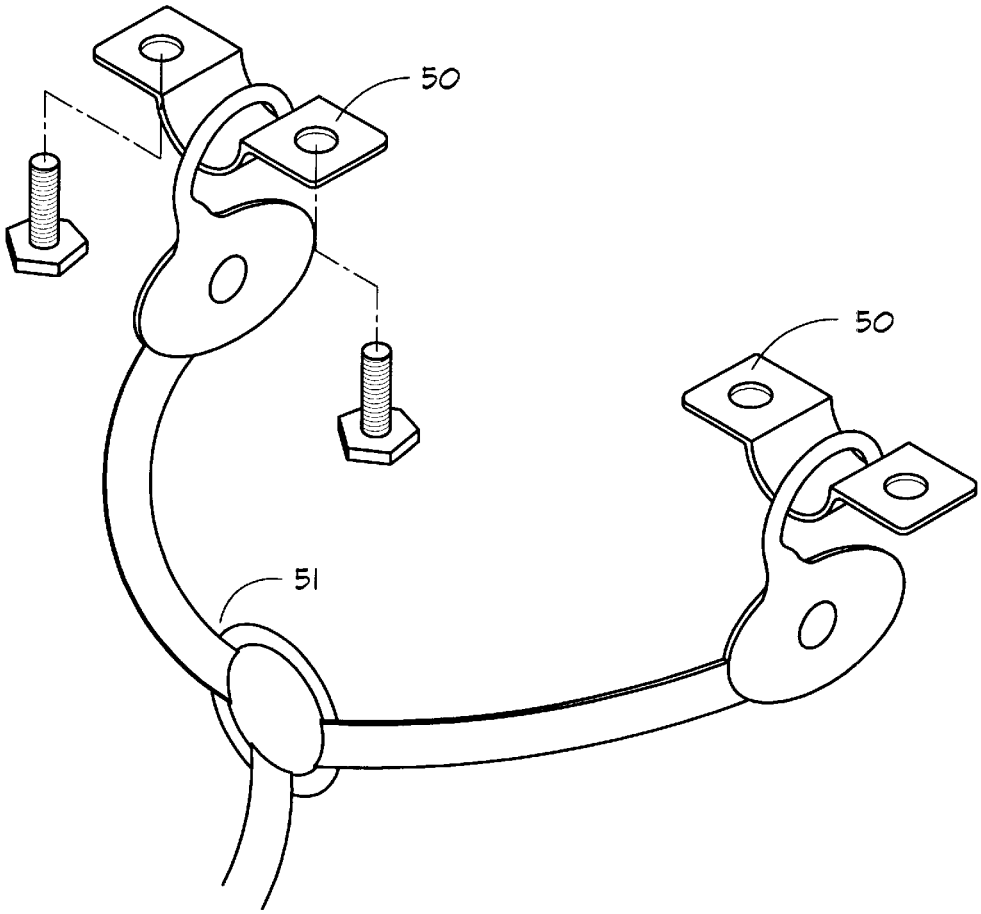
FIG. 15 is a perspective view of a bridle.

FIG. 13 shows how the U-bolt 27 and slotted plate 45, with upset 49, allows it to conform to any pitch roof. FIG. 14 is a side view showing various angles of the U-bolt 27 and slotted plate 45. The internal nut 44 has an Allen or other internal head 48, to be tightened from below, yet still allow a bolt to be installed to secure a hook 50 so a bridle 51, can be used to go to a ground anchor. The use of the internal nut 44 makes for easier attachment due to misalignment, as the U-bolt goes through the roof and tightening must be done from below the roof.

FIG. 16A

Figure 16B:
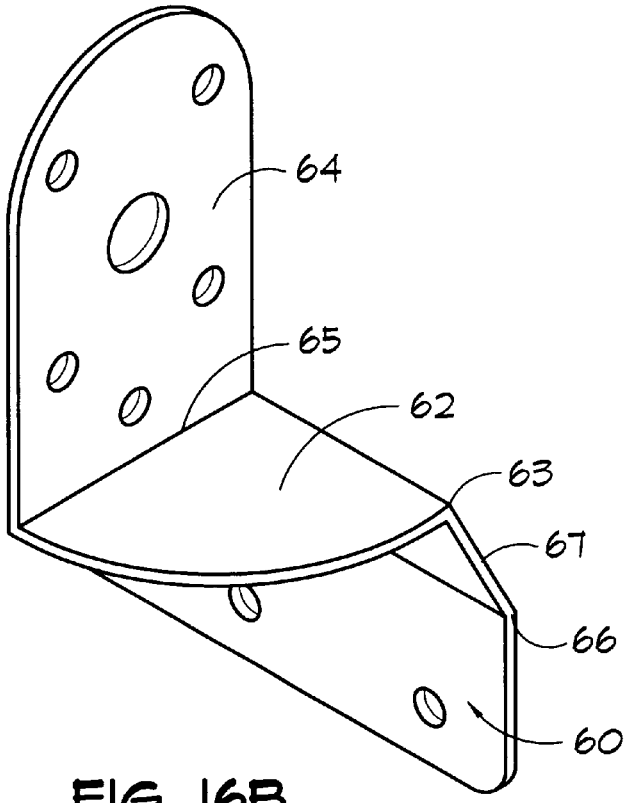
FIG. 16B is a perspective view of a right-handed ½ stealth clip.
Figure 16A:
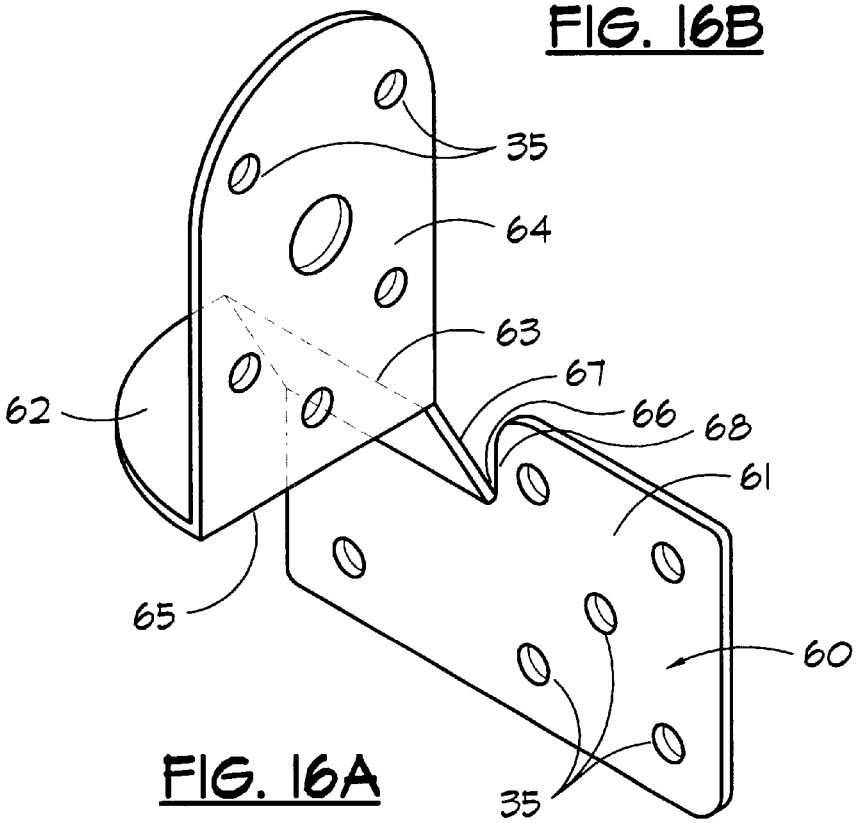
FIG. 16A is a perspective view of a left-handed ½ stealth clip.

Defer now to FIG. 16A which shows a perspective view of a ½ stealth clip 60. The ½ stealth clip is similar to the stealth clip 4 and has many of the same advantages and more. This embodiment is a left-handed ½ stealth clip 60. A right-handed ½ stealth clip is a mirror image as shown in FIG. 16B. The left-handed ½ stealth clip 60 is usually installed on the left side of a rafter, and a right-handed ½ stealth clip would be installed on the right side of the rafter.

Many homes are constructed with rafters or trusses of 2×4's, 2×6's or larger. These beams are actually 1½-inches-wide. The stealth clip 4 would work fine on these homes. Many older homes were built from rough-sided 2×'s that are actually 2-inches-wide. Some home styles, especially post-and-beam types, use 4×'s or wider to span long or wide distances. Sometimes standard rafters are doubled-up next to each other for strength. The ½ stealth clip 60 would work fine on these types of houses, as a left and right clip could be used on thicknesses greater than or less than 1½ inches.

At the gable end of a house, part of the right base member 6 or left base member 11 on a stealth clip 4 would stick out beyond the adjacent wall. At intersecting walls, the opposing wall would hit against the above base members. A left-handed or right-handed ½ stealth clip 60 would work fine in these locations.

On a hip roof, with the hip rafter bisecting the corner, a ½ stealth clip could be field-bent along the single notch 68 at approximately 45°, so that the seat saddle 62 fits under the hip rafter, and the wide base 61 fits against the wall.

The left-handed ½ stealth clip 60 has a wide base 61 connected to a saddle seat 62 by a seat saddle bend 63. A rafter member 64 is connected to a side of the seat saddle 62 by a rafter member bend 65. The wide base 61 has nail holes 35 for attachment to the outside wall sheathing W and underlying top plate T. The rafter member 64 has holes 35 for attachment to the side of a rafter R.

The rafter member bend 65 is approximately at a right angle bend to the seat saddle 62. The seat saddle bend 63 and offset bend 66 form an obtuse bend which puts the outer edge of the seat saddle 62 lower than the seat saddle bend 63. This lets the seat saddle 62 accommodate the underside of a roof rafter R, while the rafter member 64 can be attached to the "meat" or widest part of the rafter by nails through nail holes 35.

A side view of the ½ stealth clip 60 would be similar to FIG. 3 of the stealth clip 4. If the seat saddle bend 63 is formed as an obtuse bend, then the offset bend 66 and ramp 67 can be combined into an obtuse bend as shown in FIG. 4.

Installation of a left-handed ½ stealth clip 60 on an existing house is simple. The ½ stealth clip 60 is slid up under where the rafter sticks out from the house. The wide base 61 is on the left side of the rafter R, and underneath. The ½ stealth clip 60 is slid up until the seat saddle. 62 seats against the bottom part of the rafter R, the rafter member 64 is snug against the rafter R, and the wide base 61 is snug against the outside wall W.

In this position, the ½ stealth clip 60 can be secured to the rafter R and outside wall W, and clears the frieze board F. Nails or screws can be utilized with hand or power tools. If the outside wall is masonry, then nails or screws for masonry can be utilized to install the clip to the bricks or cinder blocks.

Nails driven through the nail holes 35 in the wide base 61 will penetrate the outside wall sheathing W and imbed inside the underlying top plate T. These nails securely tie the outside wall sheathing W to the underlying top plate.

The wide area of the wide base 61 forms a large washer that helps keep the outside wall sheathing W from splintering, cracking, or splitting. This also helps prevent the outside wall sheathing from bowing out or separating from the wall during strong winds.

With the wide base 61 secured to the outside wall sheathing W, and the rafter member 64 clearing frieze boards F, warped frieze boards, and wires, nails can be driven into the nail holes 35 on the rafter member 64 and into the wide side of the rafter R. The roof rafter R is now securely connected to the outside wall W and the underlying top plate T.

Since outside wall sheathing is routinely nailed to two or more wall studs S, and the wall studs S are commonly connected to the sill plate P, the rafters R and top plate T now have a continuous load path to the foundation. The wide base 61 and the base members 6, 11 and 16 of the stealth clip 4 could be extended down to catch a wall stud, but studies have shown that the stud is not always exactly under the rafter.

The wide washer-like appearance of the bases could be larger, but studies have shown that a hurricane rips the rafter from the top plate, and the outside sheathing from the top of the wall. This invention cures these problems by tying the sheathing tightly to the underlying top plate and overlying rafter. This also prevents the sheathing from splitting, bowing out, or from being shaken off. The clip helps form the outside wall into a strong shearwall.

FIG. 16B

FIG. 16B shows a right-handed ½ stealth clip. Besides fitting on odd-size or very large rafters, the ½ stealth clip 60 has other advantages. After the ½ stealth clip 60 is formed, it can "spoon" next to each other taking up less room in a shipping box. The right-handed ½ stealth clip and left-handed ½ stealth clip 60 can be installed together on a rafter. Just left-handed or just right-handed clip can be installed on a house or they can be alternated.

FIG. 17

Figure 17:
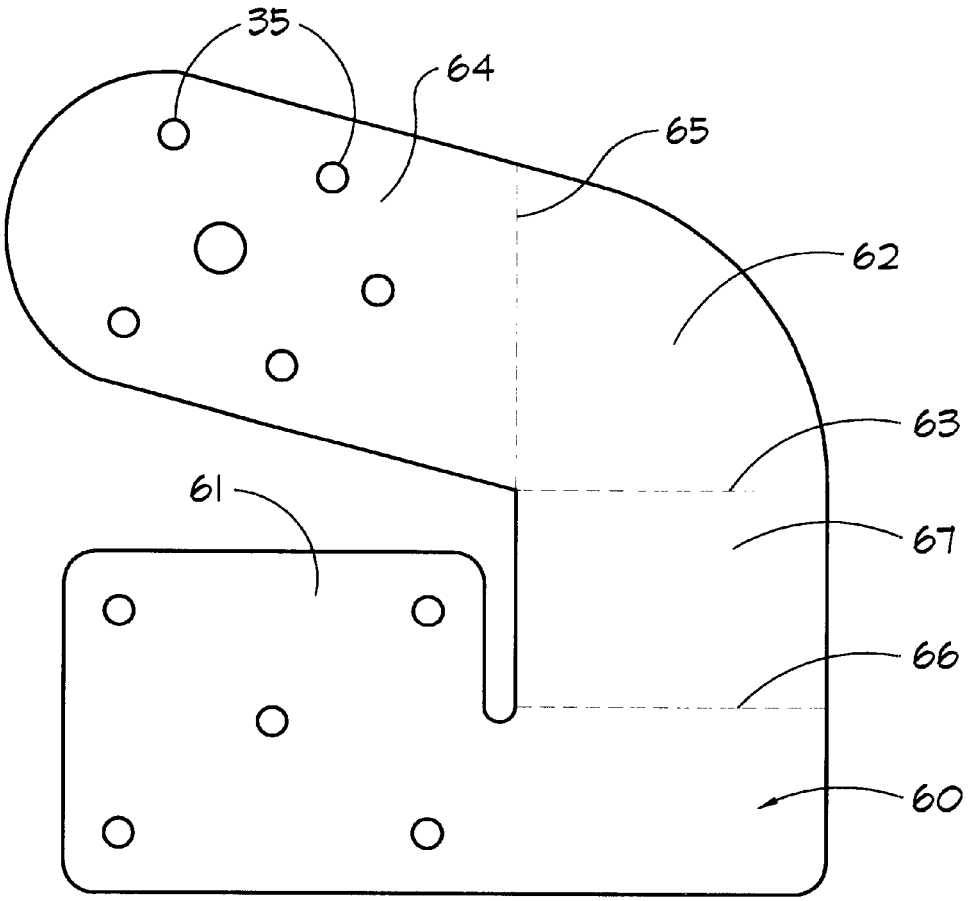
FIG. 17 is a flat pattern layout of a ½ stealth clip.

Refer now to FIG. 17 which shows flat-pattern layout of a ½ stealth clip 60 prior to bending along the indicated bend lines.

FIG. 18

Figure 18:
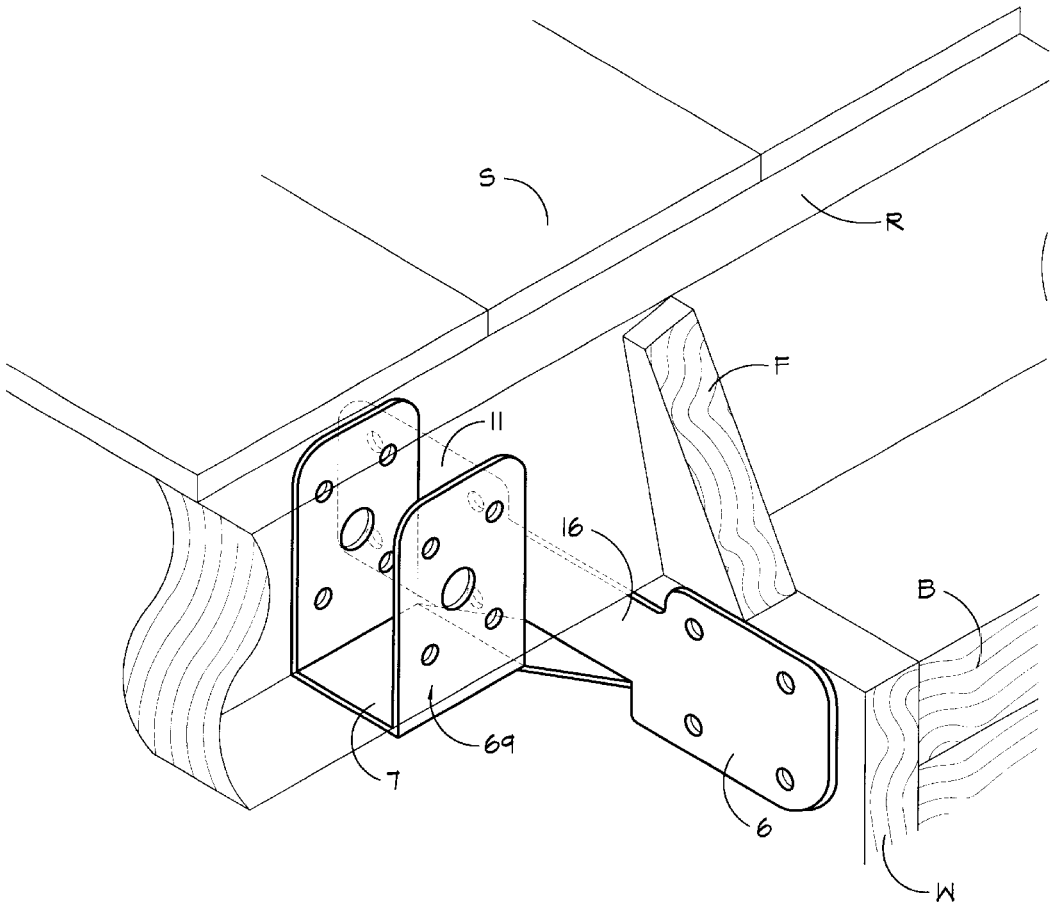
FIG. 18 is a perspective view of a bottom stealth clip.

Refer now to FIG. 18 which shows a perspective view of another embodiment, a bottom stealth clip 69. The bottom stealth clip 69 is similar to a stealth clip 4, except, the rafter saddle 7 is bent from the bottom part of the middle base member 16.

The rafter saddle 7 still cradles the rafter R, but now the rafter R can be steeply-pitched and the bottom stealth clip 69 will still have the base members 6, 11 and 16, snug against the sheathing W and underlying top plate T.

FIG. 19

Figure 19:
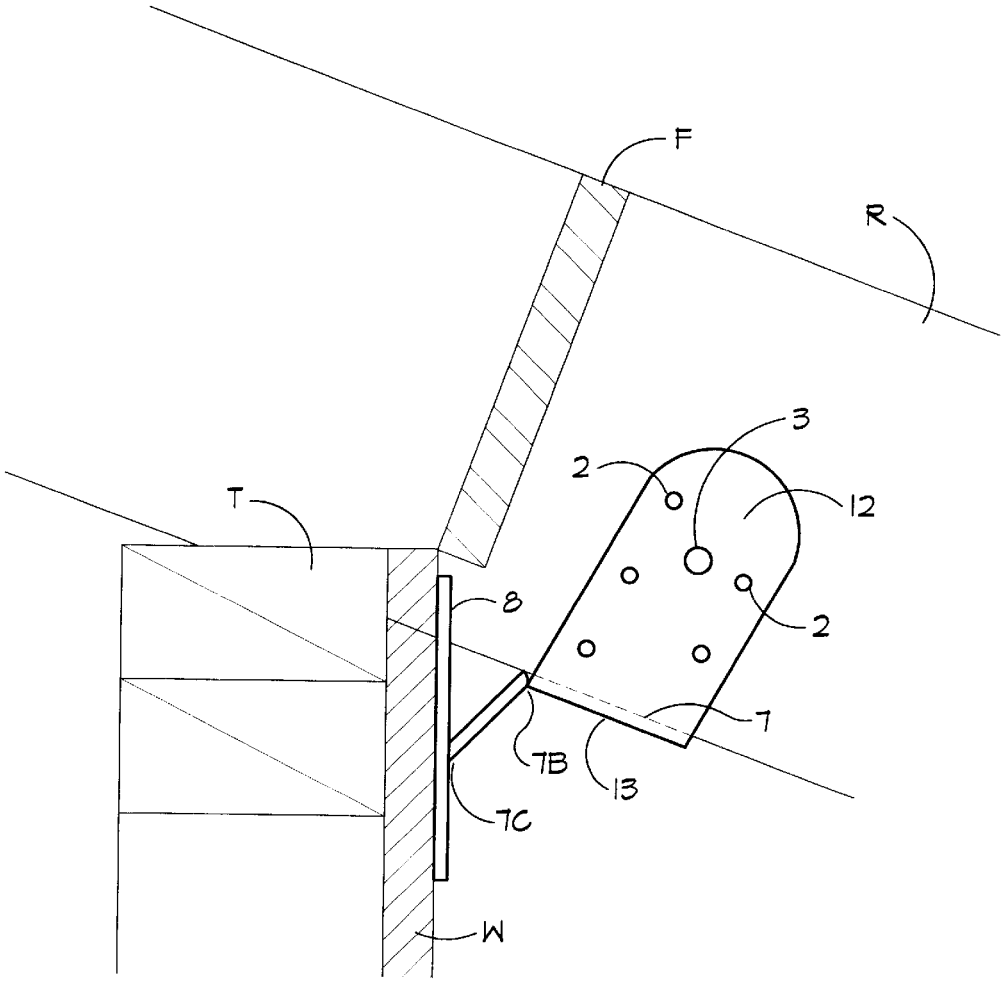
FIG. 19 is a side view of a bottom stealth clip.

Refer now to FIG. 19 which shows a side view of a bottom stealth clip 69. This view shows the base members 6, 11, and 16, helping cradle the rafter R and snug against the outside sheathing W. Nails driven through said base members will be secured into the underlying top plate T.

Besides working on steeply-pitched roofs, another advantage is that some houses are constructed with 2×6, or larger rafters, but use smaller frieze boards, such as 1×4, by notching the sheathing around the rafters and installing the sheathing flush with the top of the top plate. As shown in FIG. 19, the bottom stealth clip 69 will clear different size frieze boards F and still have the base member snug against the outside sheathing W and underlying top plate T.

Conclusion, Ramifications, and Scope of Invention

The stealth hurricane clip is a true retrofit that helps protect a house from the effects of hurricanes and earthquakes. The stealth clip holds the roof securely to the outside wall. The stealth clip helps prevent a roof rafter from lifting, twisting, moving in toward the house, moving out from the house, moving to the left, and moving to the right.

The stealth clip also holds the outside wall sheathing securely to the wall. The stealth clip helps prevent the outside sheathing from bowing out, bowing in, separating from the wall, riding over each other, and splitting.

The stealth clip turns the outside wall into a strong shear-wall and prevents the wall from racking. One progressive die can be used to make the stealth clip.

Thus the reader can see that the hurricane and seismic connectors of this invention are unique, strong, permanent, functional, and necessary. They are also simple and economical to make, requiring simple tool and dies and no welding.

This invention solves the problem of retrofitting houses to minimize high wind and seismic dangers by using an ingenious and practical connector. Many homeowners stay in their house during hurricanes, because they do not want to be caught in traffic jams trying to escape the fury, they live on a small island, or they are caught unaware.

While my above description contains many specificities, these should not be construed as limitations on the scope of the invention, but rather as an exemplification of one preferred embodiment thereof. Many other variations are possible.

For example, since the connectors are on the outside of a building, the shape can be changed slightly to make them more architecturally appealing on certain types of houses. To fit on some architectural styles of houses, the shape can be changed slightly without comprising the structural integrity of the clip. The thickness of the connector can be altered slightly, or have beveled edges or chamfer.

Rubber, plastic, foam, or resilient pads could be inserted between the connector and the outside sheathing. This would help absorb the earthquake forces without cracking, and deaden the shocks, and after-shocks.

The roof sheathing ties could have a rubber washer, O-ring, or silicone seal where it goes through the roof in order to make the connection water-proof. This will allow the tie to hold roof sheathing to the rafter, without letting water into the house. The tie could use this rubber to reduce loading and deaden shocks from a seismic event.

To fit on an infinite variety of houses, the connectors could be made of two or more pieces. The pieces could be held together by nuts and bolts in slotted holes, so that the connector could span odd-sized rafters, logs, or trusses.

The invention could use different manufacturing techniques including manipulated sheet metal, casting, forging, extrusion, and plastic molds or injection. There can also be minor variations in color, size, and materials.

This invention was over-designed in order to exceed building codes in force or any that can be anticipated. Many areas have no codes for retrofit's because, prior to this invention, there were no workable ties that could be retrofit to most buildings. Lag bolts, nails, screws, or bolts and washers could be used to fasten the connectors to the house.

I claim:

1. A retrofit connector for holding building structural members together comprising:

a. a U-bolt and a pair of sheathing ties;

b. said U-bolt being generally U-shaped, having generally parallel threaded rods on either end;

c. each sheathing tie having four contiguous sides forming a generally open-box shape;

d. each sheathing tie having one of said sides generally vertical forming a flat back;

e. each sheathing tie having an attached top web generally perpendicular to said flat back;

f. said top web having a bolt hole for receiving one of said threaded rods of said U-bolt;

g. said top web and said flat back connected by gussets, forming said open-box shape;

h. said threaded rods fastened to said sheathing ties through said bolt holes and secured with nuts.

2. The connector of claim 1 wherein said U-bolt threaded rods are spaced a predetermined width for bridging a roof rafter from above a roof.

3. The connector of claim 1 wherein said U-bolt threaded rods have a predetermined diameter and length for penetrating pre-drilled roof holes, whereby said U-bolt enshrouds a roof rafter on three sides.

4. The connector of claim 1 wherein said U-bolt threaded rods having a predetermined area for enshrouding the top of a roof and the upper part of a roof rafter.

5. The connector of claim 1 wherein each said flat back of said sheathing ties has a predetermined area and a plurality of nail holes for fastening to a side of a roof rafter.

6. The connector of claim 1 wherein said U-bolt enshrouding roofing material, roof sheathing, and upper part of a roof rafter, and said threaded rods passing through pre-drilled holes in a roof and received into each said bolt hole on each said sheathing tie, which is fastened to opposite sides of a roof rafter, thereby forming a secure connection between said roof and said rafter and whereby preventing wind and seismic damage to a building.

7. The connector of claim 1 wherein each said flat back is fastened to opposite sides of a rafter such that the bolt holes are spaced apart a distance approximately the same as the spacing of the threaded rods of the U-bolt.

8. The connector of claim 1 wherein said generally open-box shape allows a nut to be turned onto the threaded rods of the U-bolt once passed through the bolt holes of the top webs of the sheathing ties.

9. A retrofit connector for holding building structural members together comprising:

a. a U-bolt and a singular wall plate;

b. said U-bolt being generally U-shaped, having generally parallel threaded rods on either end;

c. said wall plate hating a generally rectangular shape and flat back;

d. said wall plate having a foundation web attached generally perpendicular to said wall plate;

e. said foundation web having an attached pair of frame webs, that are generally perpendicular to said wall plate and generally perpendicular to said foundation web;

f. said foundation web and said frame webs forming a braced platform near the center of said wall plate;

g. said foundation web having a pair of holes for receiving said threaded rods of said U-bolt;

h. said singular wall plate and said U-bolt secured together with nuts.

10. The connector of claim 9 wherein said U-bolt threaded rods have a predetermined diameter, a predetermined length, and a predetermined spacing for penetrating pre-drilled roof holes, whereby a top section of said U-bolt bridges a roof rafter from above a roof, and said threaded rods enshroud said roof rafter on two adjacent sides.

11. The connector of claim 9 wherein said singular wall plate has a plurality of nail holes for fastening to a wall of a house.

12. The connector of claim 9 wherein said U-bolt having a U-shaped section enshrouding roofing material, roof sheathing, and upper part of a roof rafter, and said threaded rods passing through pre-drilled holes in said roof and received into each hole on a braced platform, formed by said foundation web and pair of frame webs, whereby said braced platform, attached to said wall plate, which is fastened to the building wall, thereby forming a secure connection between said roof and said wall, whereby said connector helps prevent wind and seismic damage to a building.

13. A retrofit connector for holding building structural members together comprising:

a. a U-bolt, a singular wall plate, and slotted plate;

b. said U-bolt being generally U-shaped, having generally parallel threaded rods on either end;

c. said slotted plate having slots for receiving said threaded rods;

d. said wall plate having a generally flat back;

e. said wall plate having an attached foundation web, generally perpendicular to said wall plate;

f. said foundation web having an attached pair of frame webs, that are generally perpendicular to said wall plate and generally perpendicular to said foundation web;

g. said pair of frame webs having attachment to said wall plate;

h. said foundation web having a pair of holes for receiving said threaded rods of said U-bolt;

i. said singular wall plate, said slotted plate, and said U-bolt secured together with internal nuts.

14. The connector of claim 13 wherein said U-bolt threaded rods have a predetermined diameter, a predetermined length, and predetermined spacing for penetrating said slotted plate and pre-drilled roof holes, whereby a top section of said U-bolt bridges a roof rafter from above a roof, and said threaded rods enshroud said roof rafter on two other sides.

15. The connector of claim 13 wherein said singular wall plate has a plurality of nail holes for fastening to a wall of a house.

16. The connector of claim 13 wherein said singular wall plate having said foundation web, and said pair of frame webs form a braced platform that can receive said internal nuts.

17. The connector of claim 13 wherein said internal nuts have a stem with internal threads for receiving said threaded rods of said U-bolt, a domed head on the opposite side for pivoting in each said hole on said foundation web, and a hex shape on the bottom for turning.

18. The connector of claim 13 wherein said U-bolt having a U-shaped section enshrouding the slotted plate, roofing material, roof sheathing, and upper part of a roof rafter, and said threaded rods passing through the slotted holes on the slotted plate, pre-drilled holes in a roof, and received into each stem of said internal nut, which passes through the holes on a platform, formed by said foundation web and pair of frame webs, and said internal nut hating a domed head for pivoting in the platform hole, thereby conforming said U-bolt to any slope roof with said slotted plate, whereby said connector forms a secure connection between said roof and said wall, thereby helping prevent wind and seismic damage to a building.

19. The connector of claim 13 wherein said slotted plate has a generally rectangular shape having a pair of slotted holes extending generally perpendicular to the long dimension of the rectangle and said slotted plate having a plurality of upsets on the top thereof for allowing the top section of the U-bolt to fit on any slope roof.

* * * * *